US006788905B2

(12) United States Patent
Tsutada

(10) Patent No.: US 6,788,905 B2
(45) Date of Patent: Sep. 7, 2004

(54) IMAGE FORMING APPARATUS WITH SHEET DISCHARGING DEVICE AND DISCHARGE CONTROL UNIT

(75) Inventor: Kiminobu Tsutada, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/321,731

(22) Filed: Dec. 18, 2002

(65) Prior Publication Data

US 2003/0156850 A1 Aug. 21, 2003

(30) Foreign Application Priority Data

Dec. 20, 2001 (JP) ..... P2001-388577
Nov. 21, 2002 (JP) ..... P2002-338574

(51) Int. Cl.[7] ..... G03G 15/00; G03G 15/20

(52) U.S. Cl. ..... 399/45; 399/68; 399/396; 399/405

(58) Field of Search ..... 399/45, 68, 389, 399/396, 405

(56) References Cited

U.S. PATENT DOCUMENTS 5,073,801 A * 12/1991 Haneda et al. ..... 399/45
6,259,871 B1 * 7/2001 Rider et al. ..... 399/405 X
6,522,841 B2 * 2/2003 Horikoshi ..... 399/45
6,600,570 B1 * 7/2003 D'Alessandro et al. . 399/405 X
6,671,472 B2 * 12/2003 Shimizu et al. ..... 399/45

FOREIGN PATENT DOCUMENTS

| | | |
|---|---|---|
| JP | 1-172981 | 7/1989 |
| JP | 3-196175 | 8/1991 |
| JP | 4-143785 | 5/1992 |
| JP | 4-184459 | 7/1992 |
| JP | 9-171311 | 6/1997 |

* cited by examiner

*Primary Examiner*—William J. Royer
(74) *Attorney, Agent, or Firm*—Morgan, Lewis & Bockius LLP

(57) ABSTRACT

An image forming apparatus includes a main body including a sheet transport path having an output part and an image forming part for forming an image on a sheet, and a sheet discharging device located in the vicinity of the output part, and a sheet receiving part. The sheet discharging device discharges the sheet having an image formed thereon by the image forming part. The sheet receiving part receives the sheet discharged by the sheet discharging device. The sheet discharging device includes a discharging member, disposed in the vicinity of the output part, for transporting the sheet in a nipping manner, a drive force transmitting mechanism for driving the discharging member to rotate, and a discharge control unit for controlling the drive force transmitting mechanism when the sheet passes the discharging member so as to temporarily delay a time taken for sheet discharging by the discharging member.

28 Claims, 23 Drawing Sheets

IMAGE FORMING APPARATUS WITH SHEET DISCHARGING DEVICE AND DISCHARGE CONTROL UNIT

BACKGROUND OF THE INVENTION

1. Field of the Invention

The present invention relates to an image forming apparatus, such as a copying machine and a printer. More particularly, the invention relates to an improvement of an image forming apparatus of the type in which a sheet bearing an image, which is formed by an image forming part of a main body of the image forming apparatus, is discharged to a sheet receiving part by way of a sheet discharging device.

2. Background Art

A Xerography-based copying machine will be described as a typical example of the image forming apparatus of this type. In the copying machine, a toner image is formed on an image bearing member, such as a photoreceptor drum, and the toner image is transferred onto a sheet, such as a printing paper, directly or through an intermediate transfer body. Thereafter, the toner image, not yet fixed, is fixed on the sheet, and is discharged onto a discharging tray as the sheet receiving part.

In the image forming apparatus thus constructed, a sheet discharging device is provided at a position near an output part of a sheet transport path. The sheet discharging device discharges the sheet bearing the fixed image, which has passed a fixing device, into the discharging tray. This type of sheet discharging device usually includes paired discharging rolls, and these rolls nip the sheet there between and transports the sheet in a nipping state.

When a toner image is formed on an OHP sheet at high speed, toner image fusion was found on the OHP sheet having an image formed thereon placed on the discharging tray. It was confirmed that the toner image fusion leads to image defects, such as image irregularity and image peeling.

This kind of technical problem is due to the fact that the OHP sheets are stacked while storing up therein the heat applied to the sheets by the fixing device. Therefore, it is readily understood that the problem can be solved in a manner that the OHP sheets having undergone fixing process are sufficiently cooled and then stacked.

Some approaches to the problem are proposed. In one approach, a cooling device is located downstream of the fixing device. After pass the fixing device, the OHP sheets or the like are forcibly cooled and then discharged. In another approach, the sheet-to-sheet span is increased by thinning out sheets successively transported to secure a sheet cooling time, although the copy productivity is decreased.

In the former approach, a large cooling device is required to secure a large cooling effect. Accordingly, the device cost is considerably increased. In a case where the sheet transport path ranging from the fixing device to exit rolls is curved, when the sheet is cooled by the cooling device, the sheet tends to remain curled to thereby adversely influence the post-processing of sheets.

In the latter approach, the sheets are transported in thinned-out manner. Accordingly, the copy productivity is considerably reduced. A time from the moment that the sheet leaves the fixing device to the moment when it arrives at the discharging tray and stacked therein remains unchanged. Therefore, the solution approach is insufficient in gaining such effects that the amount of heat stored up in the OHP sheets being stacked in the discharging tray is reduced, thereby eliminating image defects.

Such technical problems are found not only in the OHP sheets but also in special sheets, e.g., coated sheets.

SUMMARY OF THE INVENTION

Accordingly, an object of the present invention is to provide an image forming apparatus which, with simple construction, is capable of preventing image defects, which arise from the fusing of image forming materials (e.g., toner) of sheets to be stacked on a sheet receiving part, while minimizing the lowering of copy productivity.

The present invention provides an image forming apparatus which includes, as shown in FIG. 1, a sheet discharging device 3 located near the output part of a sheet transport path 2 within a main body 1 of the image forming apparatus and discharges a sheet S having an image formed thereon by an image forming part 11 within the main body 1 of the image forming apparatus to a sheet receiving part 4, wherein the sheet discharging device 3 comprising: a discharging member 5, disposed near the output part of the sheet transport path 2, for transporting the sheet in a nipping manner; a drive force transmitting mechanism 6 for driving the discharging member 5 to rotate; and a discharge control unit 7 for controlling the drive force transmitting mechanism 6 when the sheet S passes the discharging member 5 to thereby delay a time taken for sheet discharging by the discharging member 5.

In the thus implemented technical idea, the image forming part 11 involves various types of image forming systems, if those are capable of forming an image on a sheet S, such as a Xerography-basis image forming system, electrostatic image forming system, and an ink jet image forming system.

The image forming part 11 shown in FIG. 1 employs the Xerography-basis image forming system. The image forming part 11 includes an image forming engine 8 for forming an image on a sheet S on the sheet transport path 2, which is supplied from a sheet supplying unit 12, a transfer member 9 for transferring the image formed by the image forming engine 8 onto the sheet S, and a fixing unit 10 for fusing and fixing the image transferred onto the sheet S.

Particularly, in the embodiment in which the image forming part 11 includes the fixing unit 10, the fixing unit 10 discharges the sheets S bearing the images fused and fixed. When the sheets S are stacked while storing up heat, the technical problem (image irregularity, the peeling of an image) appears remarkably. In this respect,: the present invention effectively operates in the embodiment.

Even in an image forming part not including the fixing unit 10, for example, the one based on an ink jet image forming system, when the sheets S are stacked before the ink is dried, the technical problem (image irregularity, the peeling of an image) arises. Therefore, the present invention also effectively operates also in this case.

Where the sheet discharging device 3 is provided near the output part of the sheet transport path 2 in the main body 1, it may be incorporated into the main body 1 of the image forming apparatus as its constituent part or as a separate unit.

The sheet receiving part 4 may take any form if it is capable of receiving sheets S discharged from the sheet discharging device 3. The sheet receiving part 4 may directly be installed on the top part of the main body 1 of the image forming apparatus or it may be installed on the side of the main body 1 in the form of a tray member.

Usually, the discharging member 5 is constructed with a pair of rolls 5*a* and 5*b*, and one of the rolls serves as a drive roll and the other, as a follower roll. Further, the discharging member 5 may be constructed with paired belts, or a combination of a roll and a belt.

The drive force transmitting mechanism 6 may take any suitable form if it is capable of transmitting a driving force from a drive source (which may be a drive source dedicatedly provided or another drive source which is used for another driving purpose) at an appropriate reduction ratio or speed increase ratio.

The discharge control unit 7 may include any means capable of controlling the drive force transmitting mechanism 6 so as to temporarily delay a time taken for the discharging member 5 to discharge the sheet S. The discharge control unit 7 may be designed so as to control the coupling/decoupling of the drive source to the drive force transmitting mechanism 6, or to control a combination of drive force transmitting members.

The control by the discharge control unit 7 may be any control if it is capable of temporarily delaying a time taken for the discharging member 5 to discharge the sheet S. For example, it may set the sheet discharging speed by the discharging member 5 at a slow speed. A preferable control by the discharge control unit 7 is to temporarily stop the discharging member 5.

The control may be implemented such that it temporarily stops the drive/rotation of the discharging member 5 when the sheet S passes the discharging member 5.

If the sheet S being discharged is stopped, there is a chance that the user mistakenly pulls out the sheet S being stopped. To lessen occurrence of such a chance, when the temporarily stopping/discharging process is carried out, it is preferable that when the drive/rotation of the discharging member 5 is temporarily stopped, the discharge control unit 7 releases the discharging member 5 from its restraint by the drive force transmitting mechanism 6, whereby the sheet S being nipped by the discharging member 5 is allowed to freely be pulled out.

If so done, even when the user pulls out the sheet S being stopped, there is less chance that the discharging member 5 and the sheet S are both damaged.

Another control for the temporarily stopping/discharging process by the discharge control unit 7 is to set a sheet-to-sheet span to be wider than a normal sheet-to-sheet span.

In the embodiment, a delay amount of the sheet discharging time is secured by the widening of the sheet-to-sheet span. A preferable embodiment to widen the sheet-to-sheet span is to widen the sheet-to-sheet span so that a time from an instant that the trailing edge of the sheet S passes the fixing unit 10 till the trailing edge passes the discharging member 5 exceeds a predetermined value of time necessary for cooling the sheet S.

The discharge control unit 7 may carry out the temporary delaying process for all the sheets S, but it is preferable that the discharge control unit 7 selects the temporary delaying process of the time taken for the discharging member 5 to discharge the sheet S, according to a sheet kind.

In this case, the discharge control unit 7 selectively carries out a temporary delaying process of the time taken for the discharging member 5 to discharge the sheet S, according to a sheet kind.

In some kinds of sheets, there is no necessity of executing the temporary delaying process. In such a case, in the embodiment, the temporary delaying process is not carried out to thereby eliminate useless execution of the temporary delaying process.

The word "sheet kind" involves sheet size as well as sheet material.

A typical example of sheet S, which creates the technical problem to be solved by the invention, is an OHP sheet. Therefore, when applied to the OHP sheet, the present invention is useful in particular.

In this case, it is preferable that the discharge control unit 7 selectively carries out a temporary delaying process of the time taken for the discharging member 5 to discharge the sheet S, at least under a condition that the sheet S is an OHP sheet.

Even in the case of the OHP-sheet, in a slip sheet mode in which a plain paper is inserted as a slip sheet between the OHP sheets, the technical problem to which the invention is directed does not arise since the slip sheet is inserted between the OHP sheets.

Accordingly, when a slip sheet mode is selected, the discharge control unit 7 preferably prohibits the temporary delaying process of the time taken for the discharging member 5 to discharge the sheet S, even under a condition that the sheet S is an OHP sheet.

Further, it is preferable for the discharge control unit 7 to variably set a delay time of a time taken for the discharging member S to discharge the sheet S, according to a sheet kind.

This embodiment can handle with such a situation that a time necessary for cooling the sheet S is different depending on a sheet kind.

Preferably, the temporary delaying process to be carried out by the discharge control unit 7 is selected according to a job condition.

In a preferable example of such, the discharge control unit 7 selectively carries out a temporary delaying process of a time taken for the discharging member 5 to discharge the sheet S, according to the set number of sheets in one subject job.

In some set numbers of sheets in a job to be processed (the smaller number of sheets), there is no necessity of executing the temporary delaying process. In such a case, the temporary delaying process is not carried out to thereby eliminate useless execution of the temporary delaying process, in the embodiment.

The temporary delaying process, carried out by the discharge control unit 7, is not always applied uniformly to the entire one subject job, but may be applied selectively to a part of the one subject job.

This may be implemented such that the discharge control unit 7 selectively carries out a temporary delaying process of a time taken for the discharging member 5 to discharge the sheet for the set number of sheets in one subject job, which is larger than a predetermined number of sheets and for those sheets subsequent to a specified number of sheets.

There is a case where the temporary delaying process is not required for some numbers of sheets in one job (a first sheet, first several number of sheets, or the like). In such a case, the temporary delaying process is not carried out to thereby eliminate useless execution of the temporary delaying process, in the embodiment.

The temporary delaying process by the discharge control unit 7 may be executed every single job, preferably for the continuous job process.

This may be implemented such that under a condition that a certain job to be processed is continuous to one subject job, the discharge control unit 7 selectively carries out a temporary delaying process of a time taken for the discharging member 5 to discharge the sheet S according to the set number of sheets, which is the sum of the set number of sheets in the preceding job and that in the subsequent job.

The jobs of the continuous job process may be considered to be equivalent to a succession of jobs.

The term "preceding job" involves a plurality of jobs as well as a single job.

In the case of the continuous job process, it is preferable to consider a time between the adjacent jobs.

In this case, the discharge control unit 7 selectively carries out a temporary delaying process of a time taken for the discharging member 5 to discharge the sheet S, in consideration of a time between the adjacent jobs additionally.

In the embodiment, the time between the jobs is taken into consideration for the following reason. When the time between the jobs is long, there is a case where though those jobs are contained in the continuous job process, such jobs are merely single jobs and it can be hardly conceived that those jobs are successive jobs. Therefore, it is necessary to judge whether or not the jobs are substantially successive continuous jobs.

In the present invention, it is preferable that the discharge control unit 7 is capable of varying the set number of sheets and a specific number of sheets.

Further, the discharge control unit 7 is preferably capable of removing a temporary delaying process of a time taken for the discharging member 5 to discharge the sheet S.

If so done, the user who does not need the temporary delaying process may be put out of the control on the temporary delaying process.

The image forming apparatus may include a forcibly cooling device for cooling a surface of a sheet S, if necessary.

The forcibly cooling device may be a heating/cooling element, such a cooling fan or a Peltier element.

The forcibly cooling device may be located at the sheet transport path 2 ranging to the discharging member 5, or located so as to cool a surface of a sheet S nipped by the discharging member 5.

In the embodiment, it is satisfactory for the forcibly cooling device to exhibit an auxiliary cooling function. Accordingly, the cooling device itself may be small in size, and not increased in cost.

According to another aspect of the invention, there is provided an image forming apparatus which, as shown in FIG. 1, includes a sheet discharging device 3 located near the output part of a sheet transport path 2 within a main body 1 of the image forming apparatus and discharges a sheet having an image formed thereon by an image forming part 11 within the main body 1 of the image forming apparatus to a sheet receiving part 4, wherein the sheet discharging device 3 comprising: a discharging member 5, disposed near the output part of the sheet transport path 2, for transporting a sheet S in a nipping manner; a plurality of discharging paths A and B of different lengths provided within a range from the image forming part 11 to the discharging member 5 of the sheet transport path 2; and a discharge control unit 7 for selecting discharging path A or B according to a sheet kind or job condition.

In FIG. 1, the sheet transport path 2 of the discharging path B is selected to be longer than that of the discharging path A.

In the embodiment, the discharging path A or B is selected according to the sheet kind or job condition.

For example, when an OHP sheet is used, the discharging path B of which the sheet transport path 2 is long is used to gain a time till the sheet S is discharged to the sheet receiving part 4.

Within a range from the image forming part 11 to the discharging member 5, the discharging paths A and B may be provided separately. A part of the discharging paths A and B may be commonly used.

The long discharging path B may be additionally provided. To simplify the device construction, the long discharging path B preferably is a sheet transport path used for another purpose, which is utilized in the form of a bypass.

In this case, the sheet transport path 2 used for another purpose may be a reversing transport path, both-side recording transport path, a transport path to the finisher, or the like.

In the embodiment, the discharging member 5 may be located at one discharging port or a plurality of discharging ports.

Where a plurality of discharging ports are used, viz., discharging members 5 of the discharging paths A and B are located at different positions, the sheet receiving parts.4 are separately used, and different sheets S are discharged into those sheet receiving parts 4 according to the sheet kind and job condition.

Also in the embodiment, a forcibly;cooling device for cooling a surface of a sheet may additionally be provided.

In this case, a forcibly cooling device for cooling a surface of a sheet is provided at the discharging path or discharging paths.

Where it is impossible to secure a sufficient length for the discharging path B, for example, the forcibly cooling device is installed on the discharging path B to support the cooling of the sheet S. Where it is possible to secure a sufficient length for the discharging path B, for example, the forcibly cooling device is installed on the discharging path A.

Where the sheet transport path 2 used for another purpose is used for discharging path B, and is a sheet return path for the both-sided recording or multiple recording purposes, a forcibly cooling device is provided at the sheet return path.

When the forcibly cooling device is installed at the sheet return path, it cools the sheet S to be discharged into the sheet receiving part 4. Further, when the sheet S bearing an image recorded thereon returns to the image forming part 11, it is cooled again. As a result, it is effectively avoided that temperature within the main body 1 rises.

DETAILED DESCRIPTION OF THE PREFERRED EMBODIMENTS

The preferred embodiments of the present invention will be described with reference to the accompanying drawings.

Embodiment 1

Figure 2:
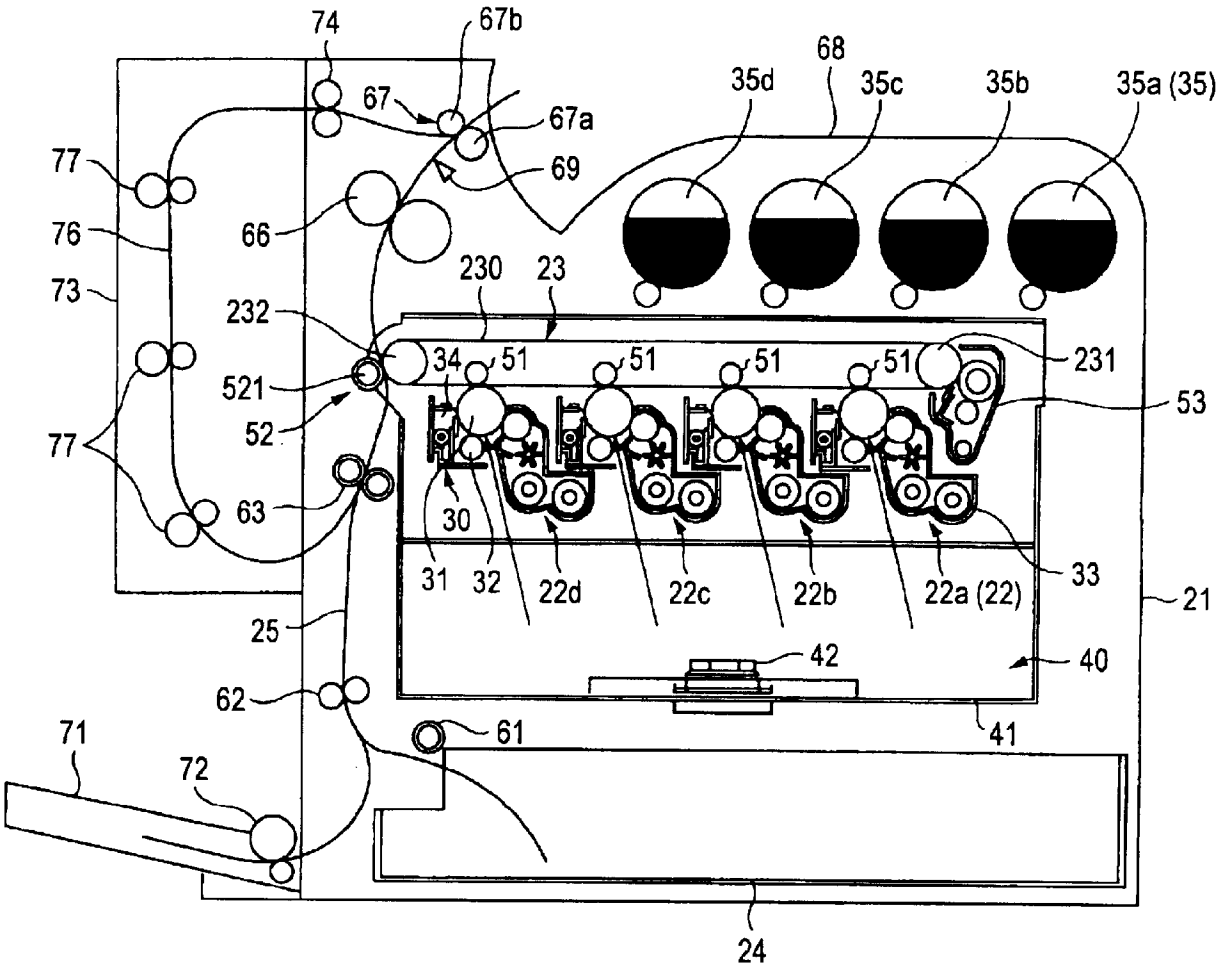
FIG. 2 is a diagram showing an overall scheme of the image forming apparatus which is an embodiment 1 of the invention.

FIG. 2 is a diagram showing a tandem type image forming apparatus incorporating the present invention, which is an embodiment 1 of the invention.

As shown, in the tandem type image forming apparatus, image forming units 22 (specifically 22*a* to 22*d*) of four colors (black, yellow, magenta and cyan in the embodiment) are horizontally arrayed within a main body 21 of the image forming apparatus. A plurality of copying units 23 including an intermediate transfer belt 230, which is circulated along the array direction of the image forming units 22, is disposed above the image forming units 22. A sheet supply cassette 24 containing sheets (not shown) or printing papers is disposed under the apparatus main body 21. A sheet transport path 25 ranging from the sheet supply cassette 24 is vertically disposed.

In the embodiment, the image forming units 22 (22*a* to 22*d*) are for forming color toner images of, for example, black, yellow, magenta and cyan in this order from the upstream side in the circulating direction of the intermediate transfer belt 230 (not always fixed to this unit array order). A single exposure unit 40 is provided in common for photoreceptor units 30 and developing units 33.

Each of the photoreceptor units 30 is constructed such that a cartridge into which a photoreceptor drum 31, a charging device (charging roll in this instance) 32 for charging the photoreceptor drum 31 in advance, and a cleaner 34 for removing residual toner on the photoreceptor drum 31 are integrally assembled into a cassette, viz., it takes the form of a so-called CRU (customer replaceable unit).

The developing units 33 develop electrostatic latent images which are formed on the charged photoreceptor drum 31 by the exposure unit 40 by use of corresponding color toners.

Reference numeral 35 (35*a* to 35*d*) designates toner cartridges (toner supply path, not shown) for supplying color component toners to the developing units 33.

The exposure unit 40 is constructed such that four semiconductor laser devices (not shown), one polygon mirror 42, image forming lenses (not shown), and mirrors (not shown) corresponding to the photoreceptor units 30 are stored into a unit case 41. Light beams of respective color components are emitted from the semiconductor laser devices toward the polygon mirror 42; the light beams are deflected by the polygon mirror 42; and light images are respectively led to exposure points on the photoreceptor drum 31 by way of image forming lenses and mirrors.

In the embodiment, the copying unit 23 is constructed such that the intermediate transfer belt 230 is stretched between a pair of tension rolls (one of which is a drive roll) 231 and 232. Primary transfer devices (primary transfer roll in this instance) 51 are disposed on the rear side of the intermediate transfer belt 230, in association with the photoreceptor drums 31 of the photoreceptor units 30. The toner images on the photoreceptor drums 31 are electrostatically transferred onto the intermediate transfer belt 230 by applying to the primary transfer devices 51, a voltage whose polarity is opposite to that of the charged toners.

A secondary transfer device 52 is disposed at a part of the intermediate transfer belt 230, which corresponds to the tension roll 232 close to the most downstream image forming unit 22*d*. The secondary transfer device 52 secondarily transfers the primarily transferred images:collectively on the intermediate transfer belt 230 on a recording medium.

In the embodiment, the secondary transfer device 52 includes a secondary transfer roll 521 which is disposed in press contact with the toner image bearing surface of the intermediate transfer belt 230, a backup roll (tension roll 232 is used also for the backup roll in this instance), which is disposed on the rear side of the intermediate transfer belt 230 and serves as an electrode opposed to the secondary transfer roll 521.)

The secondary transfer roll 521 is earthed, and a bias voltage whose polarity is the same as the polarity of the charged toners is applied to the backup roll (tension roll 232.)

A belt cleaner 53 is disposed upstream of the most upstream image forming unit 22*a* of the intermediate transfer belt 230, and functions to remove the residual toner from the intermediate transfer belt 230.

The sheet supply cassette 24 is provided with a feed roll 61 for picking up sheets. A take-away roll 62 for feeding sheets is disposed immediately after the feed roll 61. A registration roll (register roll) 63 for supplying a recording medium to the secondary transfer part at given timings is disposed on the sheet transport path 25, located immediately before the secondary transfer part.

Reference numeral 72 designates a feed roll 72 for manually feeding the recording medium.

A fixing device 66 is installed on the sheet transport path 25, located downstream of the secondary transfer part. A sheet discharging device 67 is located downstream of the fixing device 66. Discharged sheets are contained in a discharge tray 68, provided in an upper part of the apparatus main body 21.

In the embodiment, a manual sheet inserter (MSI) 71 is provided on the side of the apparatus main body 21. A sheet on the manual sheet inserter 71 is fed toward the sheet transport path 25 by the feed roll 72 and take-away roll 62.

A both-side recording unit 73 is attached to the apparatus main body 21. When a both-side mode for recording an image on both sides of the recording medium is selected, the both-side recording unit 73 reversely rotates the sheet discharging device 67, introduces a sheet having an image recorded on one side of the medium into the apparatus inside by a guide roll 74 located just before the entrance port;, transports the sheet along a sheet return transport path 76, located inside the apparatus, by an appropriate number of transport rolls 77, and supplies again the sheet to the registration roll 63.

Figure 3:
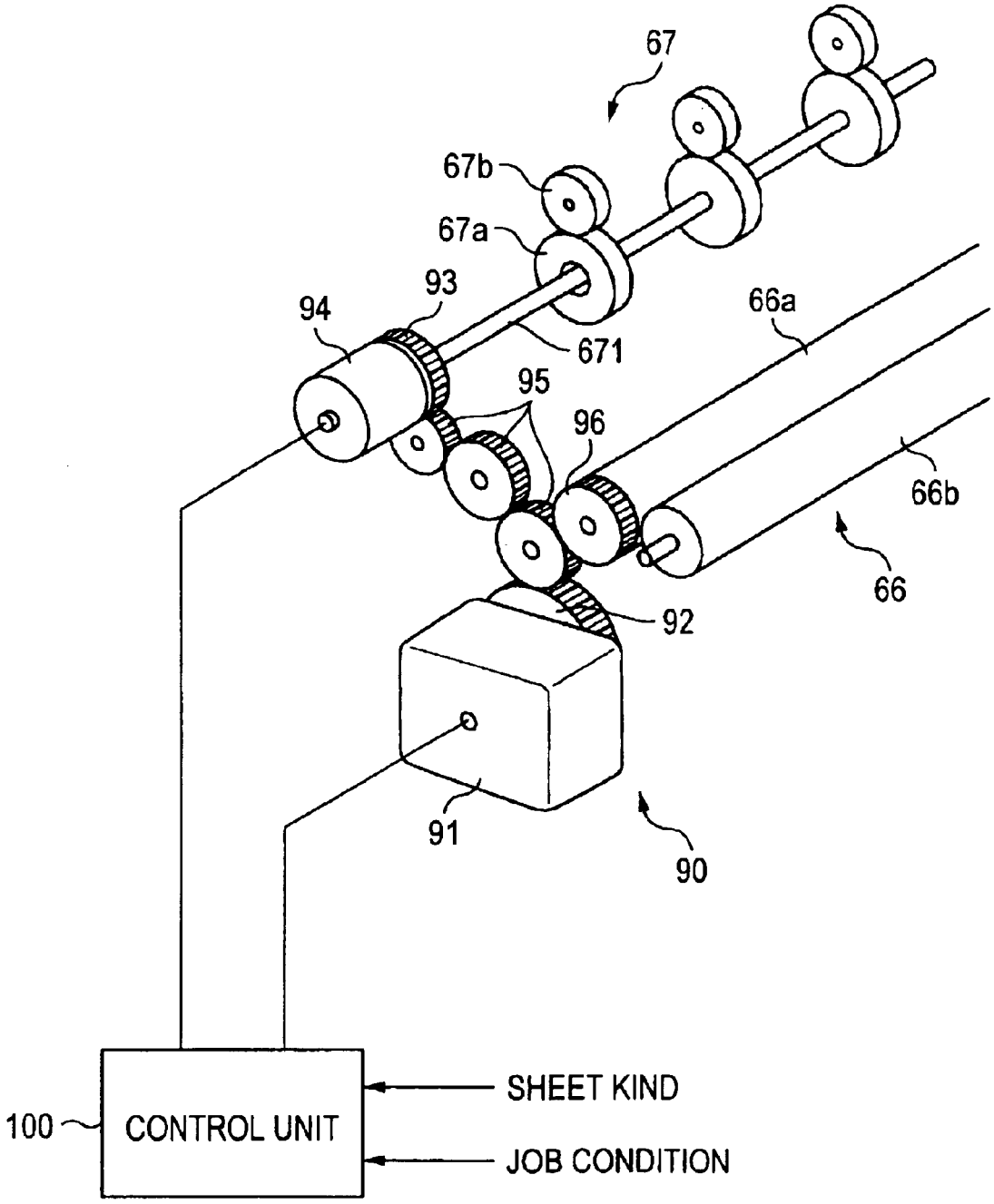
FIG. 3 is a diagram for explaining a drive force transmitting mechanism of a sheet discharging device, which is used in the embodiment.

In the embodiment, the fixing device 66, as shown in FIG. 3, is provided with a fusing/fixing roll 66*a* containing a heater (not shown) and a pressure fixing roll 66*b* which is pressed on the fusing/fixing roll 66*a* and rotates following the same.

The sheet discharging device 67, as shown in FIG. 3, includes a pair of discharging rolls 67*a* and 67*b*, which rotate while being pressed to each other. One discharging roll 67*a* is used as a drive roll, while the other discharging roll 67*b* is used as a follower roll. Those paired rolls nip the sheet therebetween and transfer it.

A discharge sensor 69 (see FIG. 2) for sensing a passing sheet is provided at a position on the sheet transport path 25, which is just before the upstream side of the sheet discharging device 67.

The discharge sensor 69 may be an optical sensor or a mechanical sensor such as a limit switch.

In the instant embodiment, the sheet discharging device 67, as shown in FIG. 3, is driven by a drive force transmitting mechanism 90.

In the drive force transmitting mechanism 90, a drive gear 92 is coupled to a rotary shaft of a reversible drive motor 91. A driven gear 93 is coupled to a shaft 671 of the discharging roll 67*a* with an electromagnetic clutch 94 being inserted therebetween in a coupling/decoupling manner. A multi-stage gear train 95 for transmitting a drive force at a predetermined reduction ratio is inserted between the drive gear 92 and the driven gear 93 in a meshing manner.

Accordingly, in the embodiment, a drive force is transmitted from the drive motor 91 to the discharging roll 67*a* through the on/off control of the electromagnetic clutch 94. In turn, the paired discharging rolls 67*a* and 67*b* are driven to rotate in either the normal direction or the reverse direction.

In the instant embodiment, the drive force transmitting mechanism 90 also drives to rotate the paired fusing/fixing rolls 66*a* and pressure fixing roll 66*b* in the fixing device 66.

In the embodiment, a driven gear 96 is directly coupled to the shaft of the fusing/fixing roll 66*a*, and the driven gear 96 comes to engage with the drive gear 92 for the drive motor 91.

It is evident that an electromagnetic clutch may be inserted between the shaft of the fusing/fixing roll 66*a* and the driven gear 96.

Figure 4:
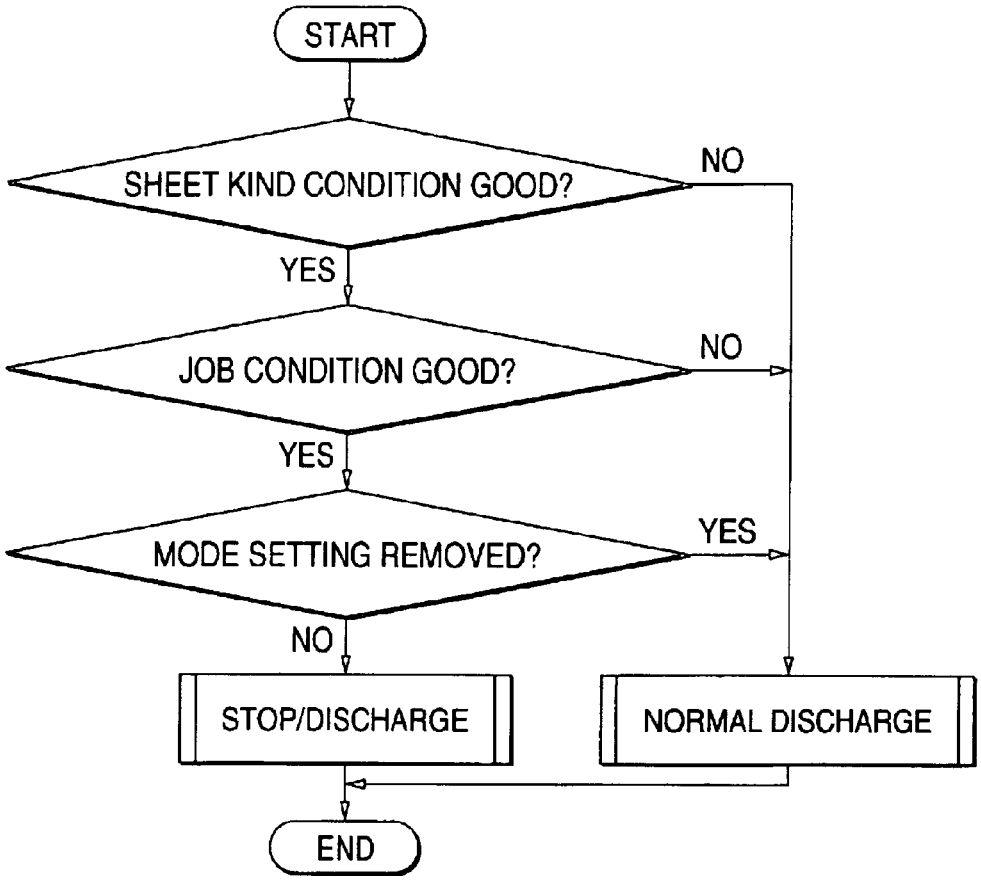
FIG. 4 is a flow chart showing a sheet discharge control process carried out by a control unit.

In the embodiment, the drive motor 91 and the electromagnetic clutch 94 are controlled in their driving in accordance with control signals output from a control unit 100. The control unit 100 executes a sheet discharge control process as shown in FIG. 4, for example, whereby it executes a discharge process (stop/discharge process or normal discharge process) for the sheet discharging device 67 according to a sheet kind and job condition.

Operations of the thus constructed image forming apparatus of the invention will be described while putting a focus on the sheet discharging device 67.

Toner images of the respective color components are formed on the photoreceptor drum 31 by the image forming units 22 (22*a* to 22*d*), and successively transferred onto the intermediate transfer belt 230.

A sheet supplied from the sheet supply cassette .24 or the manual sheet inserter 71 is transported in a substantially vertical direction through the sheet transport path 25. After positioned by the registration roll 63, the sheet is transported to a secondary transfer part of the intermediate transfer belt 230.

At the timing at which the sheet reaches the secondary transfer part, multiple toner images on the intermediate transfer belt 230 reach the secondary transfer part, and those toner images are collectively transferred onto the sheet by the secondary transfer device 52.

Thereafter, the sheet having the multiple toner images passes through the fixing device 66, and the sheet having the fixed images is discharged into the discharge tray 68 by way of the sheet discharging device 67.

During such an image forming process, a sheet discharge control process is carried out as shown in FIG. 4, by the sheet discharging device 67.

In FIG. 4, the control unit 100 first judges if a sheet kind condition is good.

Figure 5:
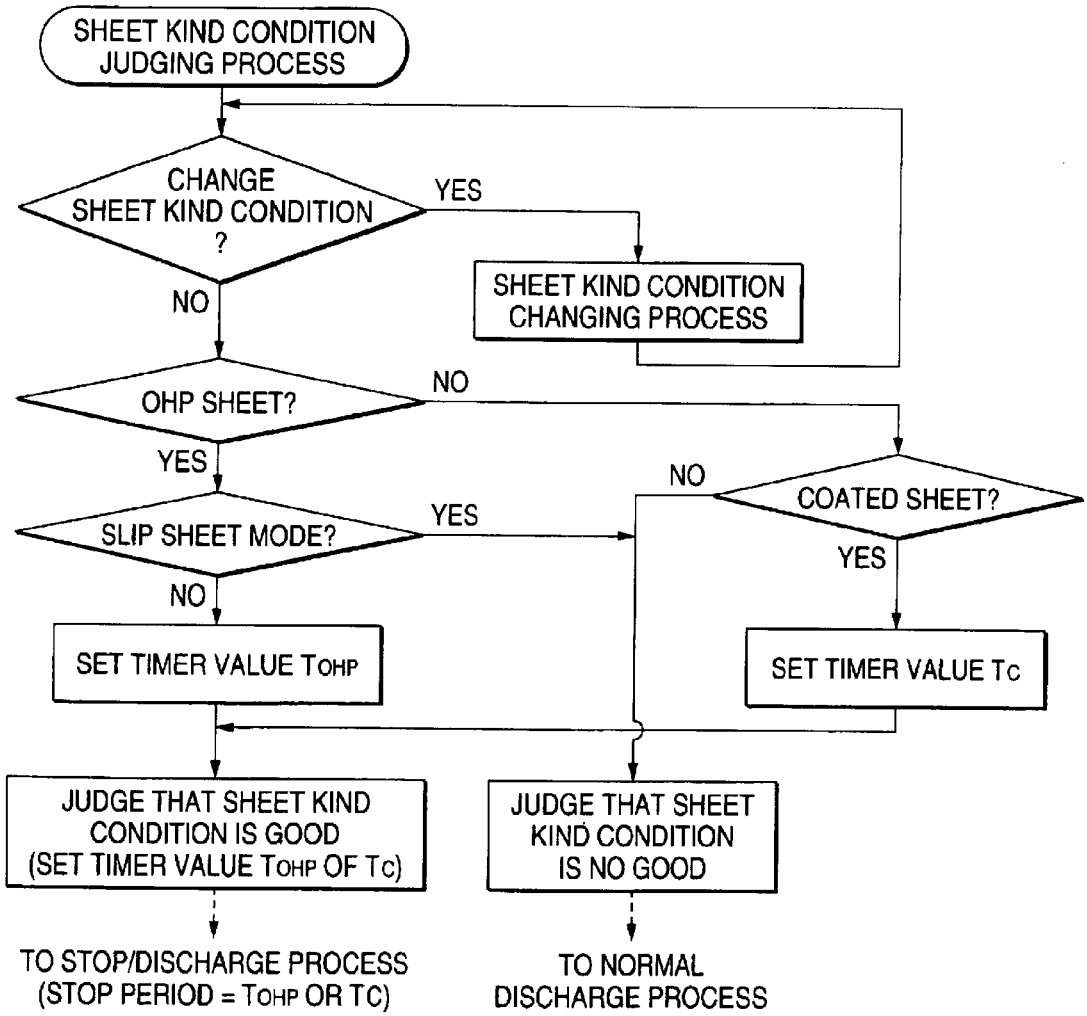
FIG. 5 is a flow chart showing a sheet kind judging process in FIG. 4.

The sheet kind condition judging process is such a process that: The control unit 100 checks if the sheet kind condition matches the condition for setting up the stop/discharge mode. If it matches the stop/discharge mode condition, the control unit 100 judges that the sheet kind condition is good. If it does not match, the control unit 100 judges that the sheet kind condition is no good. This sheet kind condition judging process may be flow charted as shown in FIG. 5.

To be more specific, in the sheet kind condition judging process, the control unit 100 first checks if the sheet kind condition is to be changed. Under a condition that a mode of changing the sheet kind condition is selected, a sheet kind condition changing process (process to change the number of sheet kinds handled in the stop/discharge mode) is carried out. Usually, the control unit 100 directly advances to the next step without carrying out such a process.

Thereafter, the control unit 100 judges the type of the sheet used among OHP sheet, coated sheet or another type of sheet (e.g., plain paper). In a mode in which the OHP sheet is selected, the control unit 100 checks if a slip sheet mode is selected. If the slip sheet mode is not selected, the control unit 100 sets a timer value $T_{OHP}$ (stop time of the stop/discharge mode), and judges that the sheet kind condition is good. If the slip sheet mode is selected, the control unit 100 judges that the sheet kind condition is no good.

If a coated sheet mode is selected, the control unit 100 sets a timer time Tc (stop time of the stop/discharge mode), and judges that the sheet kind condition is good.

Further, if another sheet kind (e.g., plain paper) is selected, the control unit 100 judges that the sheet kind condition is no good.

Thus, when the sheet kind condition is judged to be good and another condition is satisfied, the stop/discharge process is carried out. When the sheet kind condition is judged to be no good, the normal discharge process is carried out.

Next, the control unit 100 judges if the job condition is good.

Figure 7:
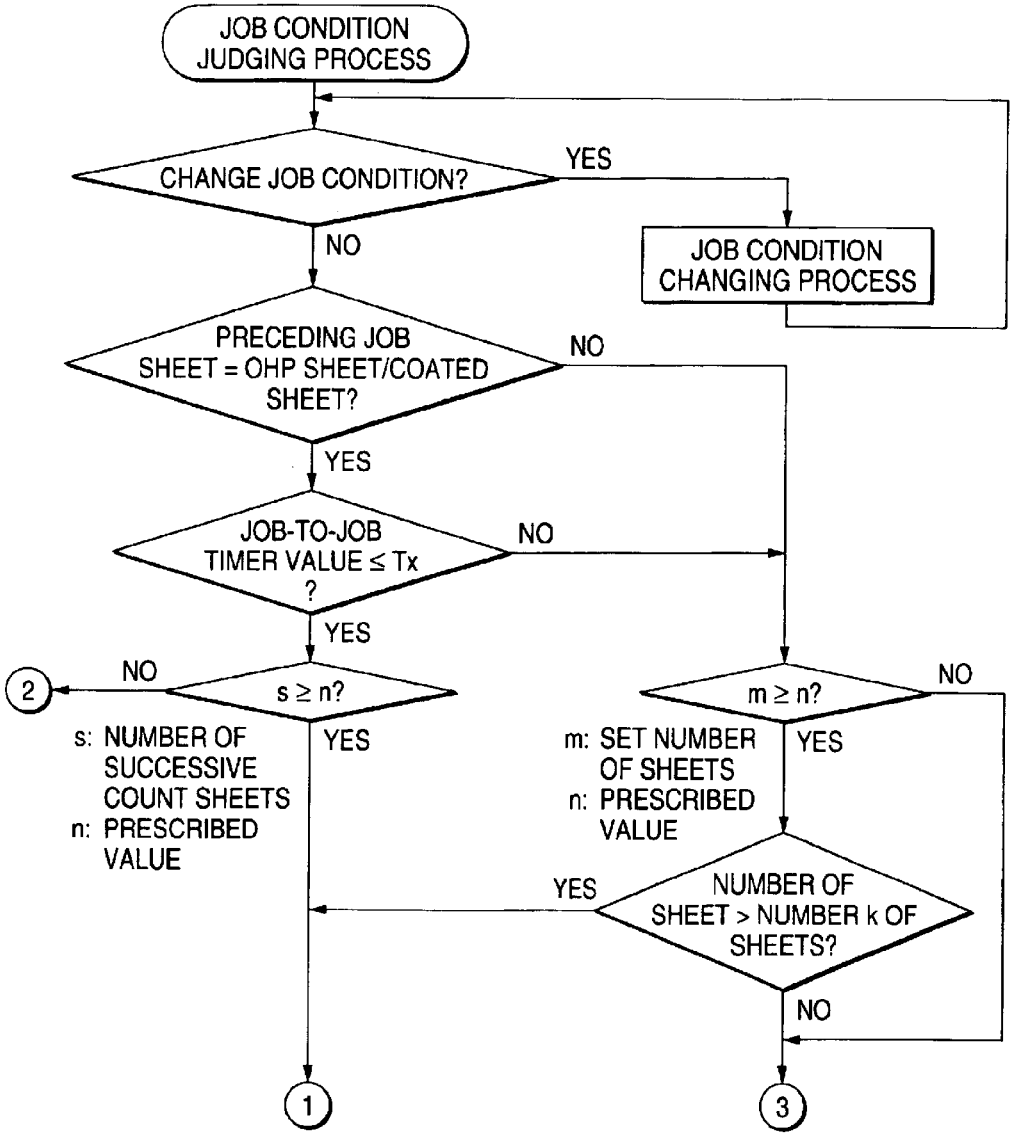
FIG. 7 is a flow chart (1) showing another job condition judging process in FIG. 4.
Figure 8:
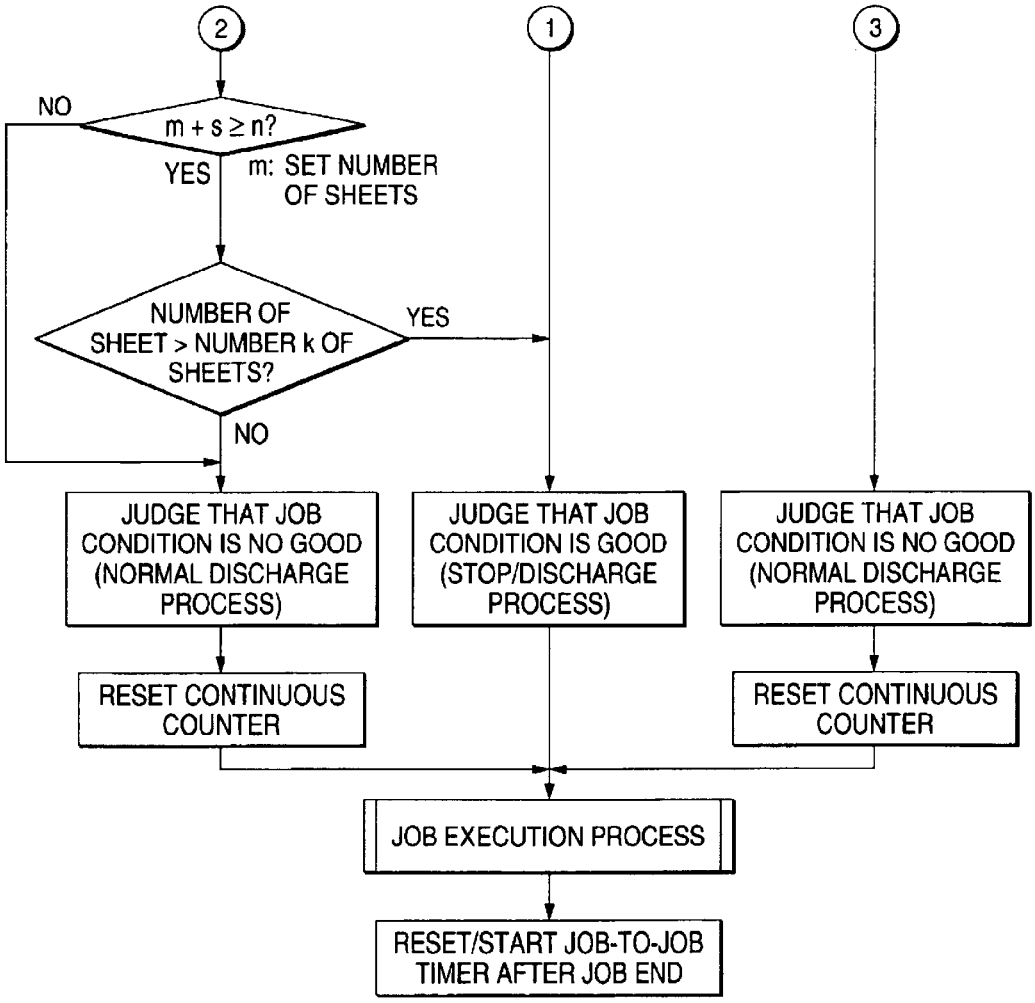
FIG. 8 is a flow chart (2) showing another job condition judging process in FIG. 4.

In a job condition judging process, the control unit 100 judges if the job condition matches the condition for setting up the stop/discharge mode. If it matches the stop/discharge mode condition, the control unit 100 judges that the job condition is good. If it does not match, the control unit 100 judges that the condition is no good. The job condition judging process may be flow charted as shown in FIGS. 6, 7 and 8.

Figure 6:
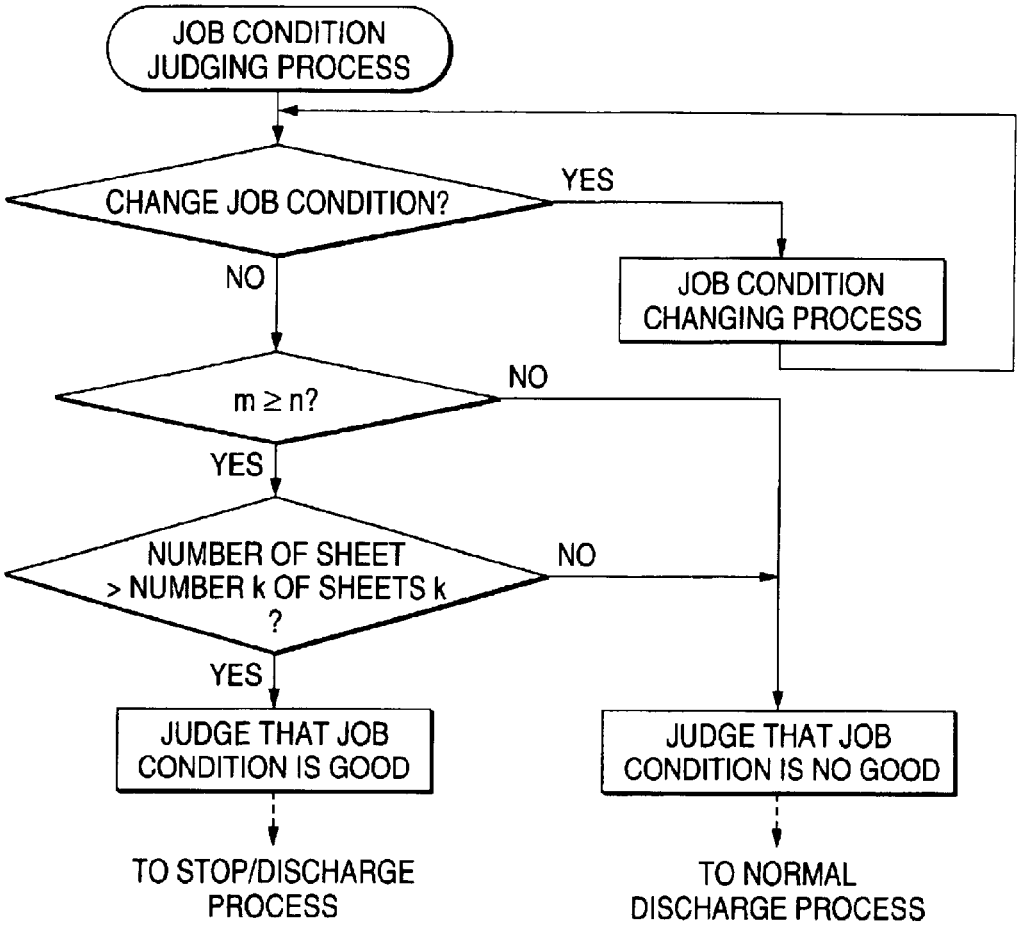
FIG. 6 is a flow chart showing a job condition judging process in FIG. 4.

A process shown in FIG. 6 is based on a job condition of each job. In this process, the control unit 100 first checks if a job condition is to be changed. If a mode to change the job condition is selected, a job condition changing process (e.g., a process of changing the set number of sheets as will be described later) is carried out. Usually, the control unit 100 directly advances to the next step without carrying out such a process.

Thereafter, the control unit 100 checks if m (set number of sheets)≧n (prescribed value). If m≧n, the control unit 100 checks whether the sheet is the k-th sheet (k=the number of sheets at the start of executing the process) or the subsequent one. If m≧n and the sheet is the k-th sheet or the subsequent one, the control unit 100 judges that the job condition is good. And if another condition is satisfied, the control unit 100 carries out the stop/discharge process.

If m<n, or m≧n and the sheet is the (k−1)th sheet or the preceding one, the control unit 100 judges that the job condition is no good, and carries out the normal discharge process.

The prescribed value "n" and the number "k" of sheets at the start of executing the process may be selected optionally.

The reason why the set number of sheets "m" is taken into consideration in selecting those numbers of sheets follows. In a case where the set number of sheets "m" is small from the start, image defects, such as image irregularity and image peeling, which arise from the fusing of fixed toner, are not caused since when the normal discharge process is carried out, and sheets are stacked in the discharge tray 68, the heat stored up in the sheets is small. Where the set number of sheets "m" is large, the amount of heat stored up in the sheets on the discharge tray 68 is also large. Accordingly, the image defects due to the fusion of the fixed toner are easy to occur, for that.

The reason why the number "k" of sheets at the process execution start is considered is as follows. Even if the set number of sheets "m" exceeds the prescribed value "n", the amount of heat stored up in the first sheets, which are stacked in the discharge tray 68, is not high. When the number of stacked sheets increases and reaches a certain number of sheets, the amount of heat stored in the sheets is large, and hence, the image defects due to the fusion of the fixed toner are easy to occur.

A process shown in FIGS. 7 and 8 is based on a job condition of continuous jobs.

The job condition judging process more exactly performs a sheet discharging operation than the job condition judging process shown in FIG. 6 since the influence of the job preceding the present job is allowed for.

In this process, the control unit 100 first checks if a job condition is to be changed, as shown in FIG. 7. If it is to be changed, the control unit 100 changes the job condition. If it is not, the control unit 100 advances to the next step.

Thereafter, the control unit 100 checks if the sheet in the preceding job was an OHP sheet/coated sheet. If the sheet in the preceding job was an OHP sheet/coated sheet, the control unit 100 checks if a job-to-job timer value is smaller than a reference value Tx.

The reference value Tx of the job-to-job timer value indicates a reference time between the adjacent jobs. When the job-to-job timer value is counted for a time in excess of the reference value Tx, the succeeding job is little influenced by the preceding job. Accordingly, those jobs may be handled as single jobs. When the job-to-job timer value is counted only for a time shorter than the reference value Tx, the succeeding job is influenced by the preceding job. In this case, those jobs may be handled as a continuous job.

Accordingly, a process of to check if the job-to-job timer value≦the reference value Tx is equivalent to a process to check if the influence of the preceding job on the subject job (succeeding job) is to be considered.

If the job-to-job timer value exceeds the reference value Tx or if the sheet of the-preceding job is a sheet (e.g., plain paper) other than an OHP sheet/coated sheet, the subject job may be handled as a single job independently of the preceding job.

When m≧n and the present sheet is the k-th sheet or the subsequent one, the control unit 100 judges that the job condition is good as shown in FIGS. 7 and 8, and executes a stop/discharge process. Here, "m" is the set number of sheets, "n" is a prescribed value, and "k" is the number of sheets at the process execution start. In other conditions than the above, viz., if m<n or m≧n, but the present sheet is the (k−1)th or the subsequent one, the control unit 100 judges that the job condition is no good, and carries out the normal discharge process.

When the job-to-job timer value is smaller than the reference value Tx, the control unit 100 references the preceding job and checks if s≧n, where "s" is the number of successive count sheets in the preceding job, and "n" is a prescribed value "n".

If s≧n, the control unit 100 immediately judges that the job condition is good, and carries out the stop/discharge process since if it carries out the normal discharge process on the OHP sheet, there is a fear of forming the image defects due to the heat stored up in the sheets.

If s<n, the control unit 100 checks both the preceding job and the subject job.

In the instant embodiment, if m+s≧n and the present sheet is the k-th sheet or the subsequent one, the control unit

100 judges that the job condition is good, and carries out the stop/discharge process, as shown in FIGS. 7 and 8. In other conditions than the above, for example, if m+s<n or m+s≧n, and the present sheet is (k−1)th sheet or the preceding one, the control unit 100 judges that the job condition is good, and carries out the normal discharge process.

When judging that the job condition is no good, the control unit 100 resets a continuous counter and executes a job. When judging that the job condition is good, the control unit 100 executes the job, and after the job execution, the control unit 100 resets and starts the job-to-job timer, and judges the job condition of the succeeding job.

Here, the job condition judging process shown in FIGS. 7 and 8 is completed.

The control unit 100, as shown in FIG. 4, checks if the mode setting is removed.

At this time, when the user operates to remove the setting of the temporary delaying process, the control unit 100 responsively removes the temporary delaying process, and always carries out the normal discharge process.

When the temporary delaying process is left set, the control unit 100 carries out the temporary delaying process or the normal discharge process according to the sheet kind condition and job condition.

The sheet discharge modes of the sheet-discharging device 67 in the image forming apparatus of the embodiment of the invention will be described respectively.

Figure 10:
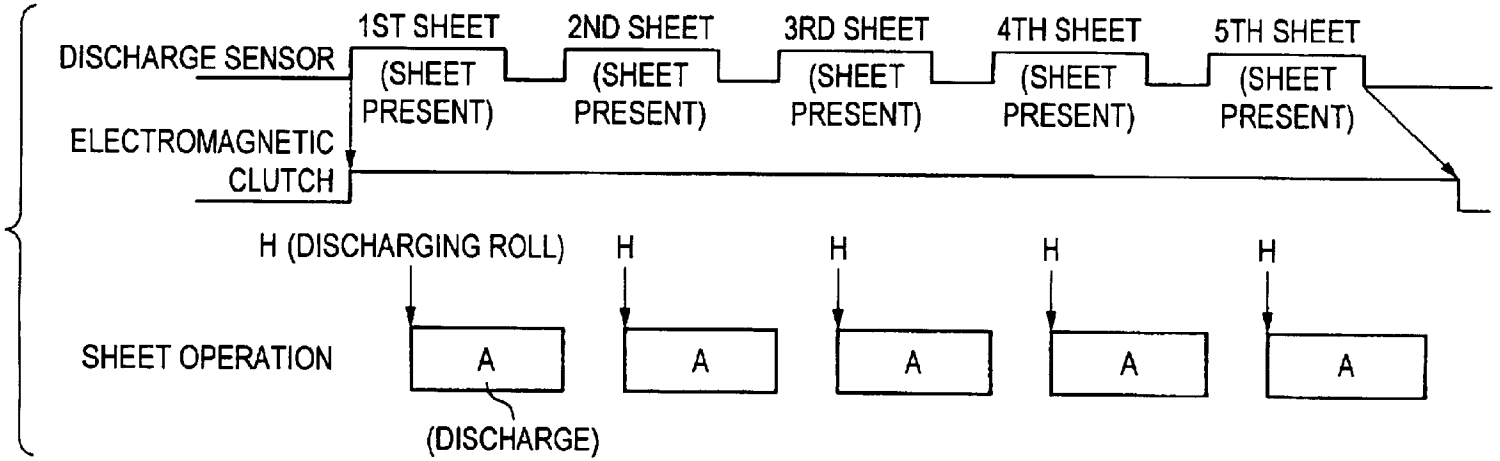
FIG. 10 is a diagram for explaining operations of a discharge sensor, electromagnetic clutch, and a sheet when the image forming apparatus is in a normal discharge mode.

<Normal Discharge Process (FIG. 10)>

Figure 9:
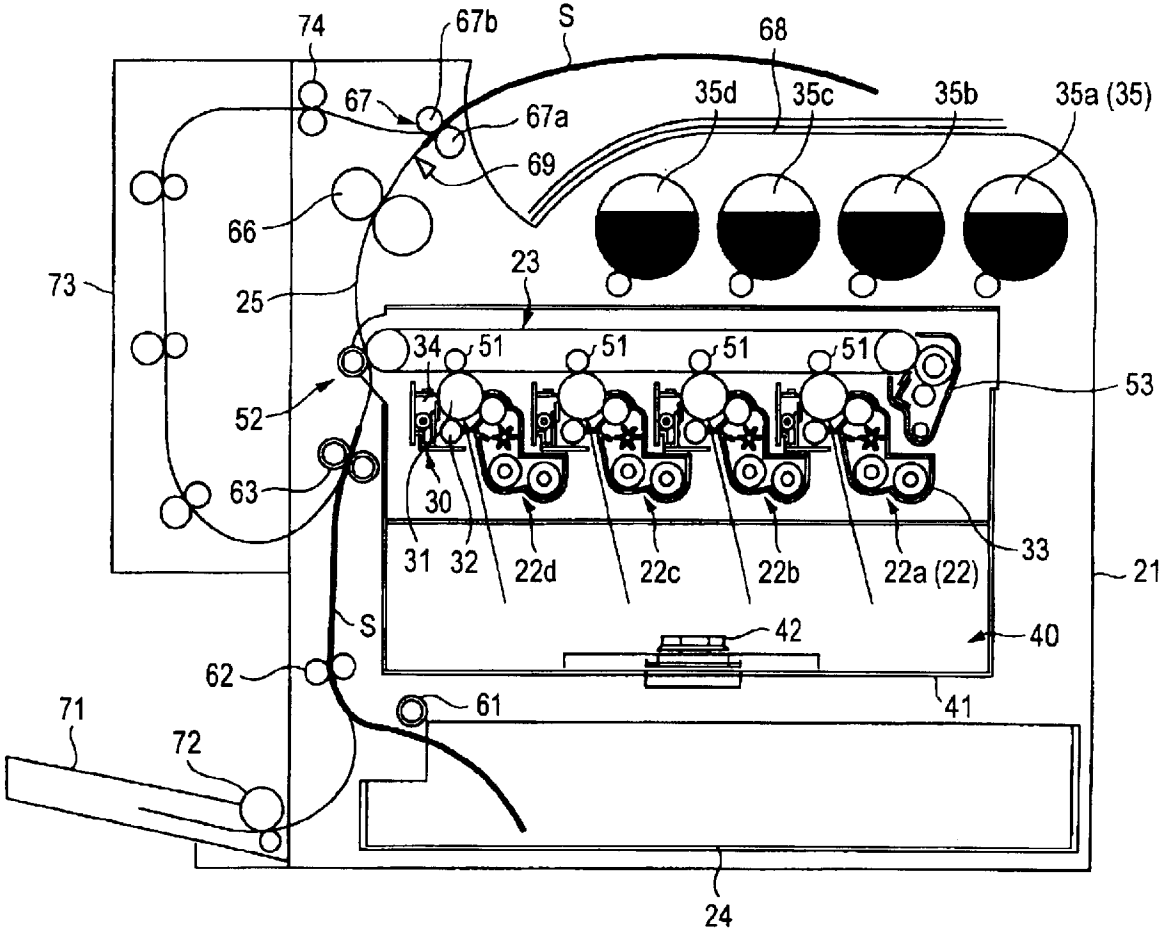
FIG. 9 is a diagram showing an exemplar operation of a stop/discharge process in the embodiment.

Operation of the sheet discharging device 67 when it is in the normal discharge process will be described. In the drive force transmitting mechanism 90 shown in FIG. 3, the electromagnetic clutch 94 is normally in an on state. A sheet S of a normal paper, for example, as shown in FIG. 9, moves along the sheet transport path 25 in the substantially vertical direction. It receives images transferred from the image forming units 22, and then is discharged to the discharge tray 68 via the fixing device 66 and the sheet discharging device 67.

At this time, the sheet S passes the discharge sensor 69, and reaches the sheet discharging device 67 at a predetermined timing, and is continuously discharged without any interruption.

<Stop/Discharge Mode (1)) (FIG. 11)>

Figure 11:
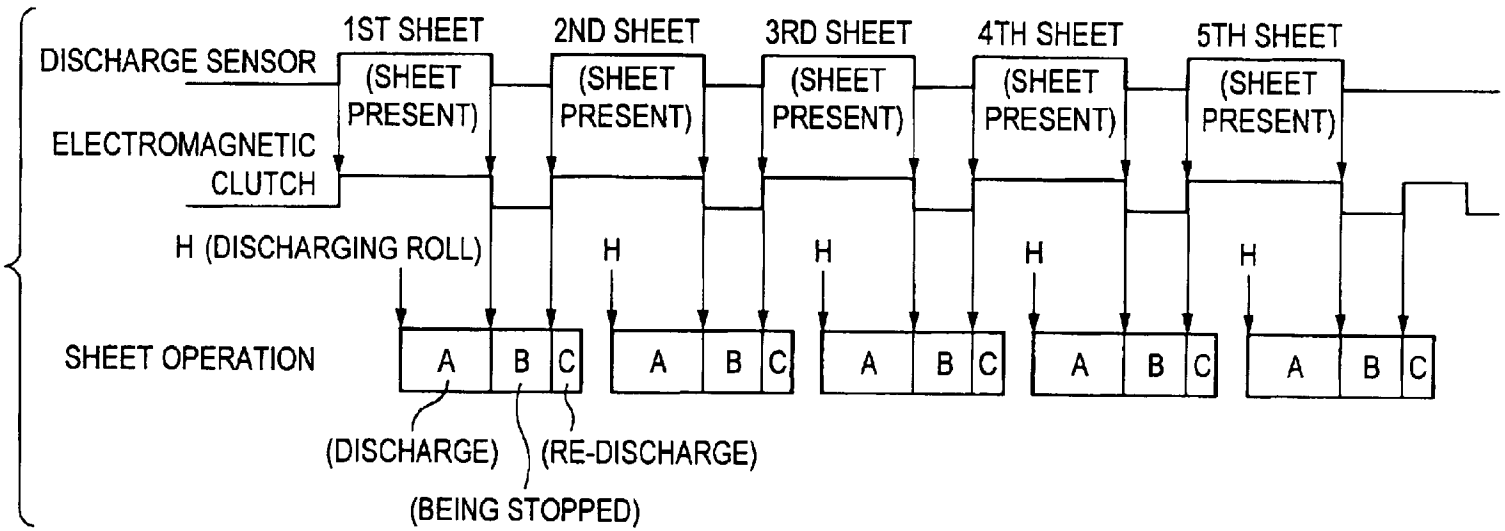
FIG. 11 is a diagram for explaining operations of the discharge sensor, electromagnetic clutch, and a sheet when the image forming apparatus is in a stop/discharge mode.

FIG. 11 shows a sheet discharging operation when a subject job is a single job, and the sheet kind is an OHP sheet, and m≧n and k=1, where "m" is the set number of sheets, "n" is a prescribed value, and "k" is the number of sheets at the process execution start.

In FIG. 11, when the sheet S passes the discharge sensor 69, and in turn the electromagnetic clutch 94 is turned on and off.

At this time, as shown in FIG. 9, at the timing that the trailing edge of the sheet S passes the discharge sensor 69, the electromagnetic clutch 94 is turned off. The discharging rolls 67*a* and 67*b* stop, and the sheet S being discharged stops while being nipped between the discharging rolls 67*a* and 67*b*.

When the leading edge of the next sheet S reaches the discharge sensor 69, the electromagnetic clutch 94 is responsively turned on. And the discharging rolls 67*a* and 67*b* turn again, and the sheet S being stopped is discharged again into the discharge tray 68.

In such a temporary delaying mode, the discharging operation of the sheet S is performed in three steps, "A (discharge)", "B (being stopped)" and C (re-discharge)", and the sheet S is sufficiently cooled during the stop of the sheet.

Accordingly, even the sheets S, e.g., OHP sheets, which are easy to suffer from the image defects arising from the toner fusion by the stored heat, are sufficiently cooled, and then stacked on the discharge tray 68. For this reason, there is no danger of forming the image defects.

Figure 16:
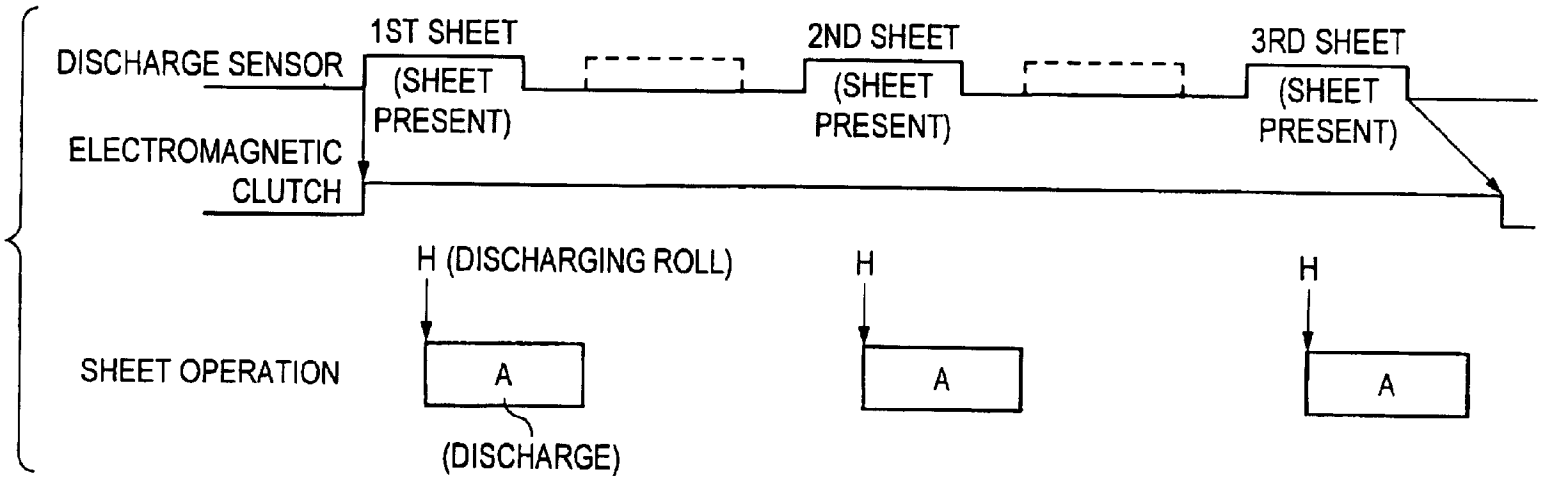
FIG. 16 is a diagram for explaining a sheet discharge mode in an example used for comparison.

In the present invention, even if the stop/discharge mode is executed, the copy productivity is not decreased, when comparing with a case where the discharge mode (sheets are discharged while being thinned out every other sheet) of a comparison example as shown in FIG. 16 is executed.

Further, in the instant embodiment, when the sheet S stops at the nip between the discharging rolls 67*a* and 67*b*, there is a danger that the user mistakenly pulls out the sheet S toward the discharge tray 68.

In the embodiment, during the off-period of the electromagnetic clutch 94, the discharging rolls 67*a* and 67*b* are free from its restraint by the drive force transmitting mechanism 90. Even if the user pulls out the sheet S being stopped, the sheet S may be smoothly pulled out with little resistance. Accordingly, there is no chance that the discharging rolls 67*a* and 67*b* or the sheet S is greatly damaged.

In the embodiment, the drive force transmitting mechanism 90 of the sheet discharging device 67 has such an original function that when the both-side recording unit 73 is used, it rotates the discharging rolls 67*a* and 67*b* in the normal and reverse directions and returns the sheet S to the both-side recording unit 73. Therefore, it is already performed that the discharging rolls 67*a* and 67*b* are temporarily stopped when the direction of the rotations of the discharging rolls 67*a* and 67*b* are switched.

Accordingly, the conventional drive force transmitting mechanism 90 may directly be applied to a situation where the stop/discharge mode is executed as in the instant embodiment. Hence, there is less danger of unnecessarily increase of the cost of the drive force transmitting mechanism 90.

<Stop/Discharge Mode (2) (see FIG. 12)>

Figure 12:
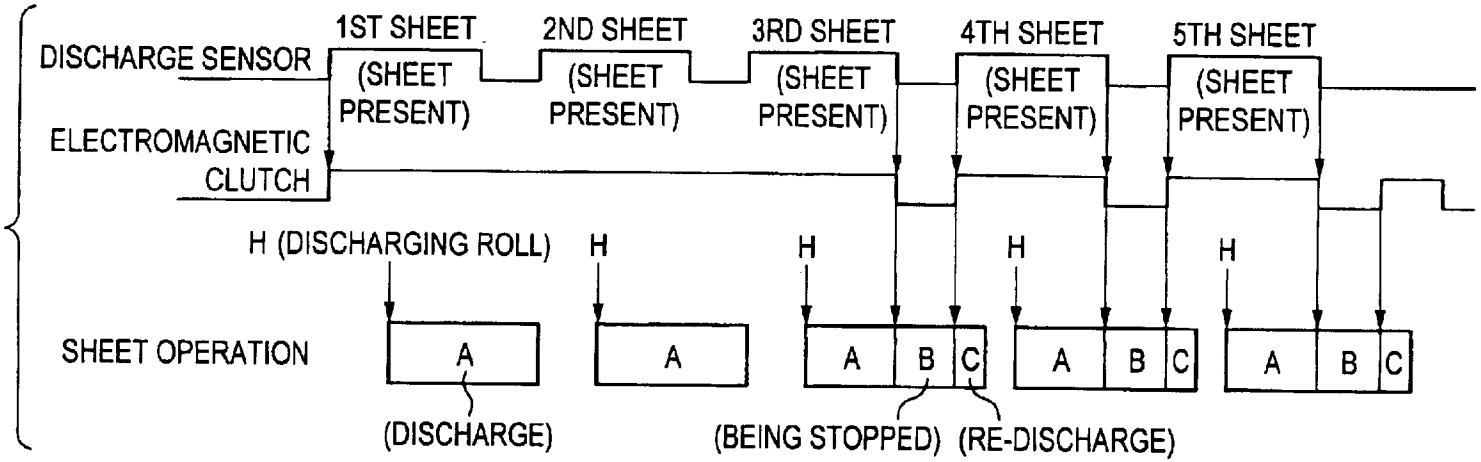
FIG. 12 is a diagram for explaining operations of the discharge sensor, electromagnetic clutch, and a sheet when the image forming apparatus is in a stop/discharge mode (2).

FIG. 12 shows a sheet discharging operation when a subject job is a single job, and the sheet kind is an OHP sheet, and m≧n and k=3, where "m" is the set number of sheets, "n" is a prescribed value, and "k" is the number of sheets at the process execution start.

In this instance, the electromagnetic clutch 94 is always in an off state during the period that three sheets S pass the discharge sensor 69. At the instant that the third sheet S has passed the discharge sensor 69, the electromagnetic clutch 94 is turned off, and subsequently, the electromagnetic clutch 94 is turned on and off in synchronism with the on and off of the discharge sensor 69.

At this time, the first and second sheets S are subjected to a process ("A (discharge") similar to the normal discharge process. The third sheet and,the subsequent ones are subjected to the stop/discharge process ("A (discharge)+B (being stopped)+C (re-discharge)").

<Stop/Discharge Mode (3) (see FIG. 13)>

Figure 13:
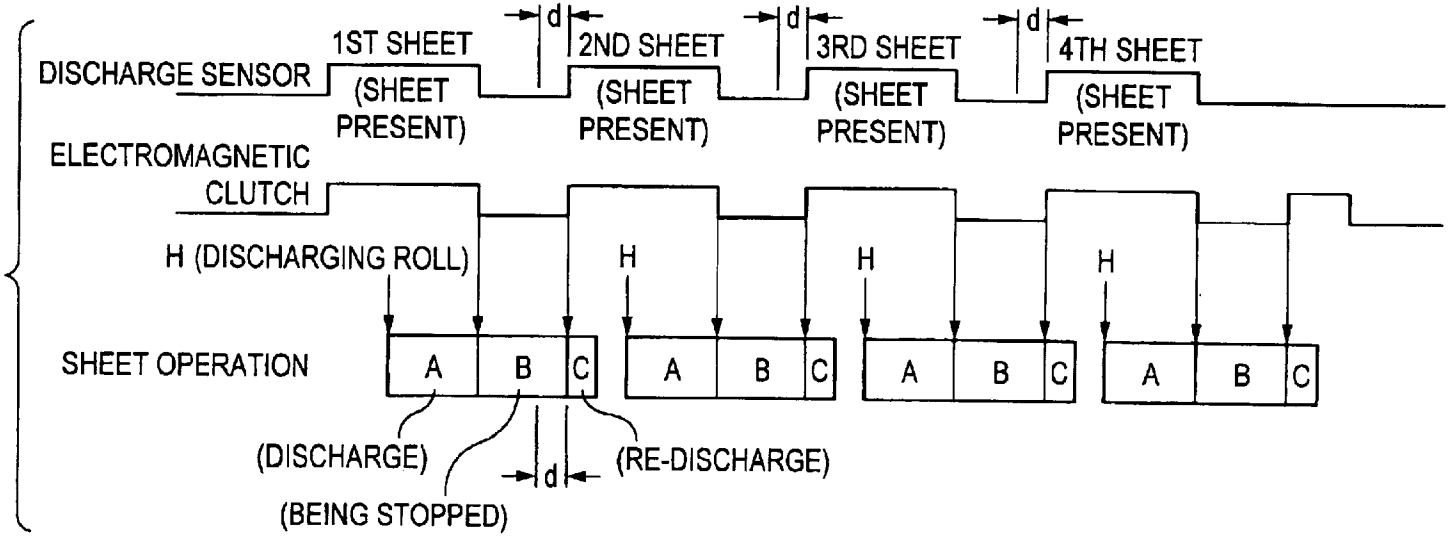
FIG. 13 is a diagram for explaining operations of the discharge sensor, electromagnetic clutch, and a sheet when the image forming apparatus is in a stop/discharge mode (3).

FIG. 13 shows a sheet discharging operation when a subject job is a single job, and the sheet kind is an OHP sheet, and m≧n and k=1, where "m" is the set number of sheets, "n" is a prescribed value, and "k" is the number of sheets at the process execution start. In this instance, the timer value $T_{OHP}$ for setting the stop time is selected to be longer than that in the stop/discharge mode (1) by "d".

In this case, the sheet S is subjected to the stop/discharge process ("A (discharge)+B (being stopped)+C (re-discharge)"). The sheet S is more cooled since "being stopped" time is long.

<Stop/Discharge Mode (4) (see FIG. 14)>

Figure 14:
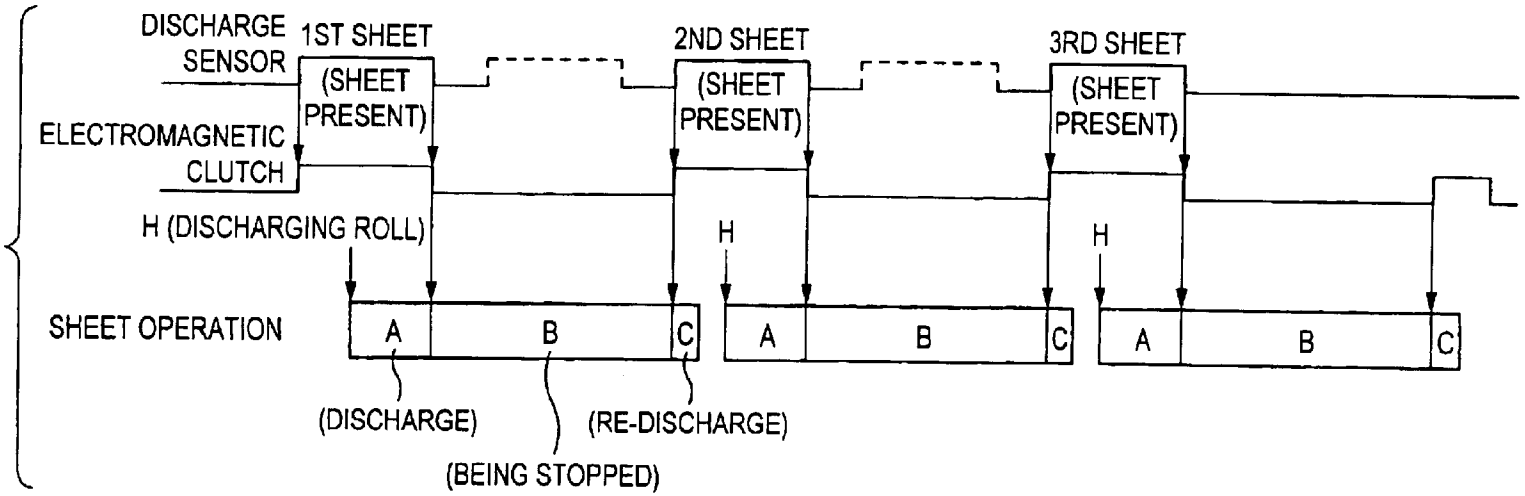
FIG. 14 is a diagram for explaining operations of the discharge sensor, electromagnetic clutch, and a sheet when the image forming apparatus is in a stop/discharge mode (4).

FIG. 14 shows a sheet discharging operation when a subject job is a single job, and the sheet kind is an OHP sheet, and m≧n and k=1, where "m" is the set number of sheets, "n" is a prescribed value, and "k" is the number of sheets at the process execution start. In this instance, the sheets S are thinned out, whereby longer sheet stop time is secured in the stop/discharge mode.

The copy productivity of this instance is substantially equal to that in the comparison example shown in FIG. 16. The stop time ("B (being stopped") of the sheet S in a state that it is nipped between the discharging rolls 67*a* and 67*b* is considerably long when comparing with that in the comparison example. Accordingly, the cooling effect of the sheet S is excellent.

<Stop/Discharge Mode Where the Continuous Job is in Consideration>

Figure 15A:
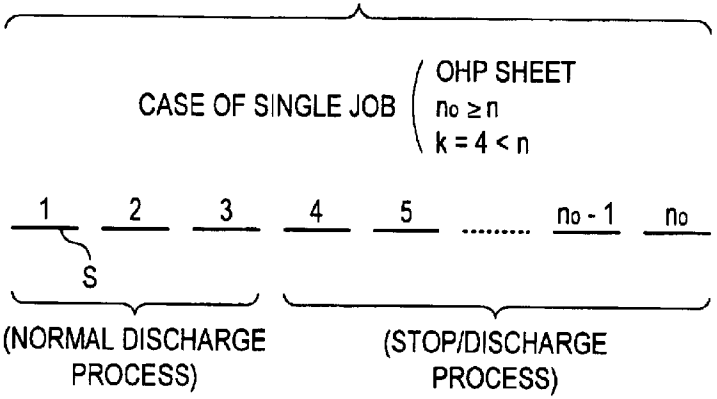
FIG. 15A is a diagram for explaining a stop/discharge mode in the case of a single job.

FIG. 15A shows a sheet discharging operation when a subject job is a single job, and the sheet kind is an OHP sheet, and m≧n and k=1, where "m" is the set number of sheets, "n" is a prescribed value, and "k" is the number of sheets at the process execution start.

Figure 15B:
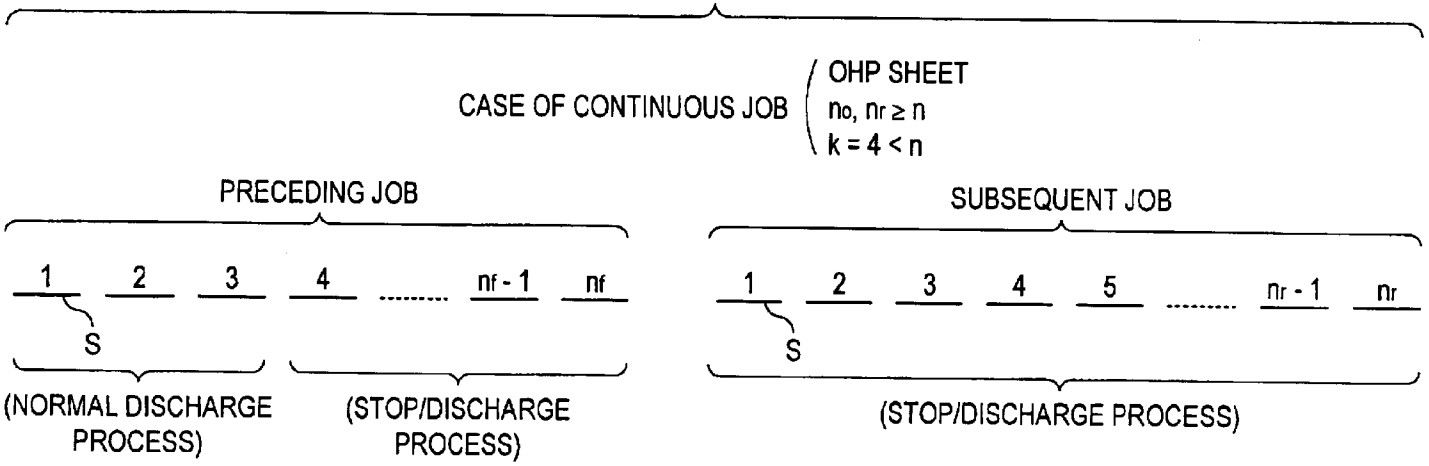
FIG. 15B is a diagram for explaining a stop/discharge mode in the case of a continuous job.

In FIG. 15, the first to third sheets S are subjected to the normal discharge process. The sheets from the fourth sheet to the $n_o$th sheet are subjected to the stop/discharge process. When the preceding job (the sheet kind is an OHP sheet, and $n_f$□n, and k=4<$n_f$, where "$n_f$" is the set number of sheets, "n" is a prescribed value, and "k" is the number of sheets at the process execution start) and the succeeding job (the sheet kind is an OHP sheet, and $n_r$□n, and k=4<$n_r$, where "$n_r$" is the set number of sheets, "n" is a prescribed value, and "k" is the number of sheets at the process execution start) are substantially continuous jobs, in the case that the stop/discharge process is being performed or immediately prior to being performed, the sheet S are subjected to the stop/discharge process from the first sheet since those jobs are continuous.

Embodiment 2

Figure 17:
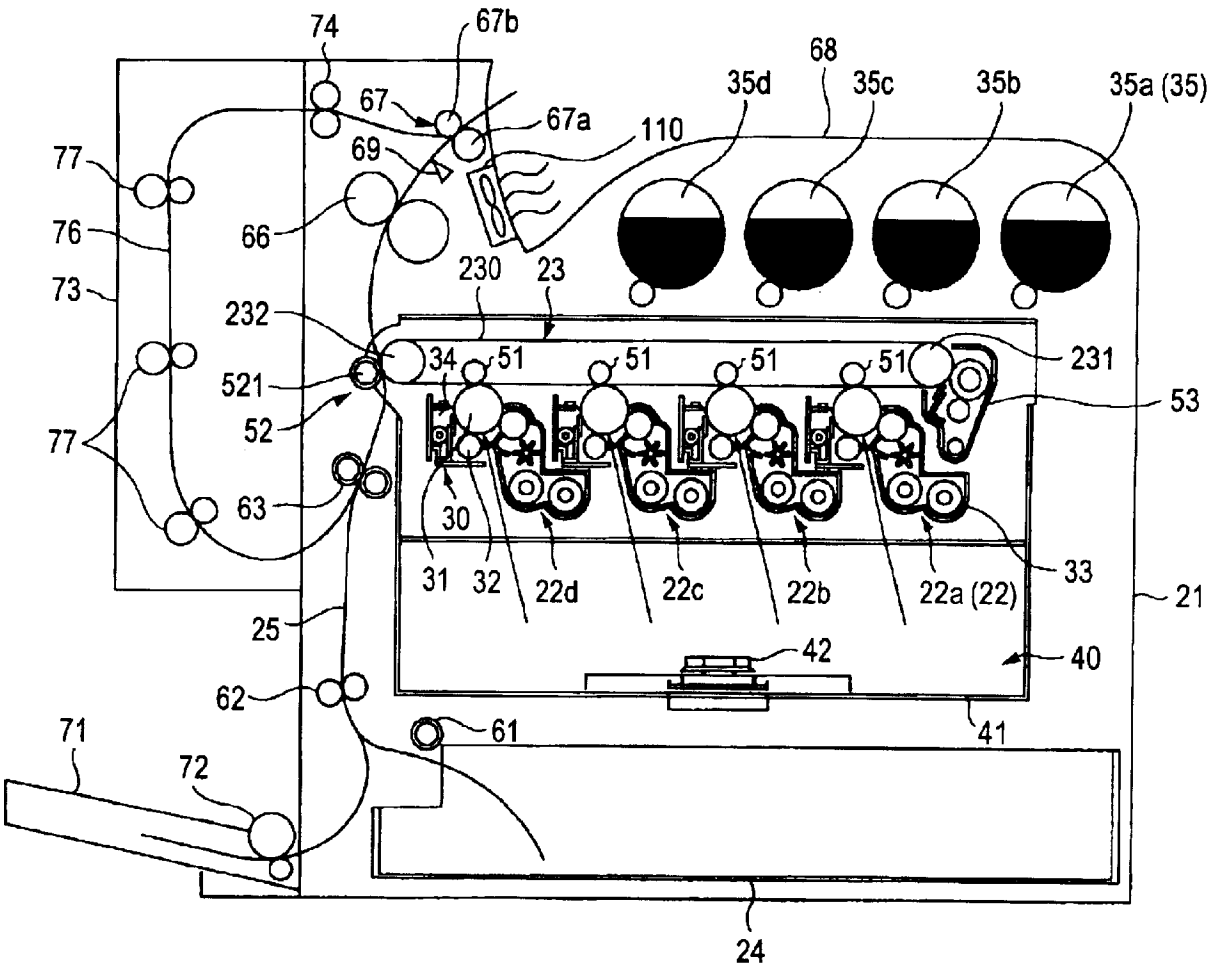
FIG. 17 is a diagram showing an overall scheme of an image forming apparatus which is an embodiment 2 of the invention.

FIG. 17 is a diagram showing an embodiment 2 of the invention.

A basic construction of the image forming apparatus of the instant embodiment is substantially the same as that of embodiment 1. The instant embodiment is different from embodiment 1 in that a cooling fan 110 as a forcibly cooling device is installed at a side vertical wall part of the sheet discharging device 67 of the discharge tray 68. The cooling fan 110 sends cooling air to the sheet which is temporarily held between the discharging rolls 67*a* and 67*b*. In the instant embodiment, like or equivalent portions are designated by like reference numerals in embodiment 1, and detailed description thereof are omitted.

The sheet is temporarily held by the discharging rolls 67*a* and 67*b* to be naturally cooled, and further it is cooled by the cooling air sent by the cooling fan 110, whereby the cooling effect is further increased.

The cooling time may be gained by temporarily nipping the sheet. Therefore, the sheet is sufficiently cooled at the stage before it is discharged into the discharge tray 68, if the capacity of the cooling fan 110 is not so large.

Figure 18A:
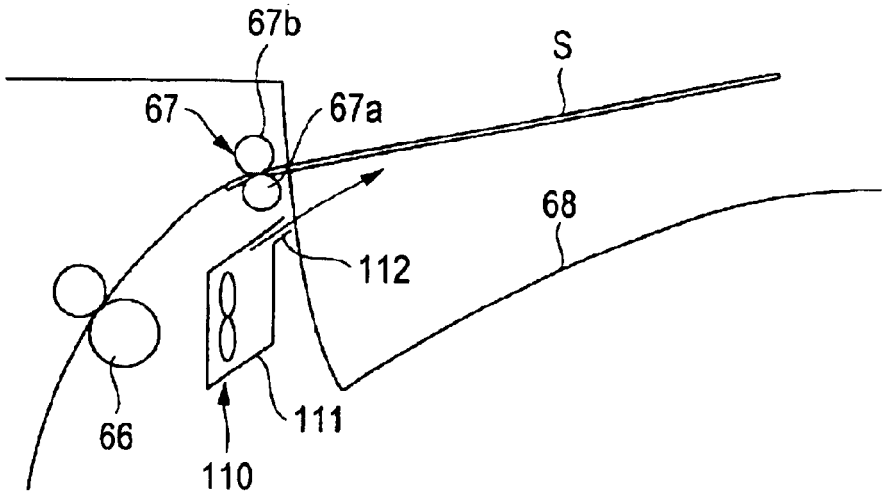
FIG. 18A is diagram for explaining a modification of a forcibly cooling device used in embodiment 2.
Figure 18B:
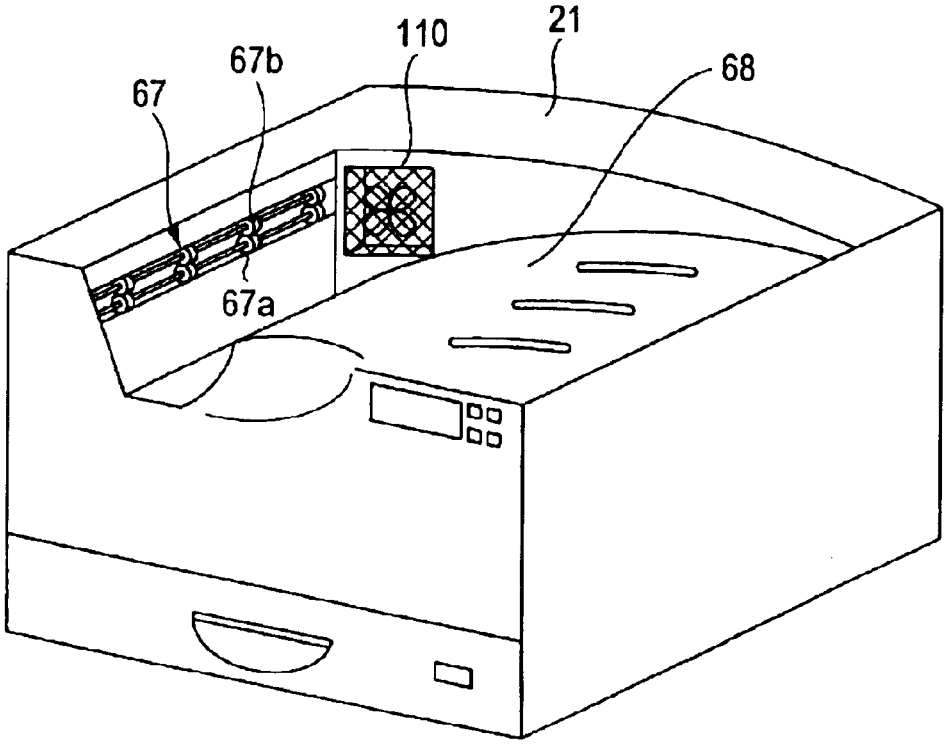
FIG. 18B is a diagram for explaining a modification of a forcibly cooling device used in embodiment 2.

The construction and layout of the cooling fan 110 may be optional. The cooling fan 110 may be installed as shown in FIG. 18A. A nozzle part 112 is formed in a fan case 111 of the cooling fan 110. The cooling fan 110 sends cooling air to only the sheet S temporarily nipped between the discharging rolls 67*a* and 67*b*. Accordingly, the cooling fan 110 has no influence on the sheets stacked in the discharge tray 68. The cooling fan 110 may also be installed as shown in FIG. 18B. The cooling fan 110 is disposed on the rear side of the apparatus main body 21, and cooling air is sent from the side as viewed in the sheet discharging direction.

Embodiment 3

Figure 19A:
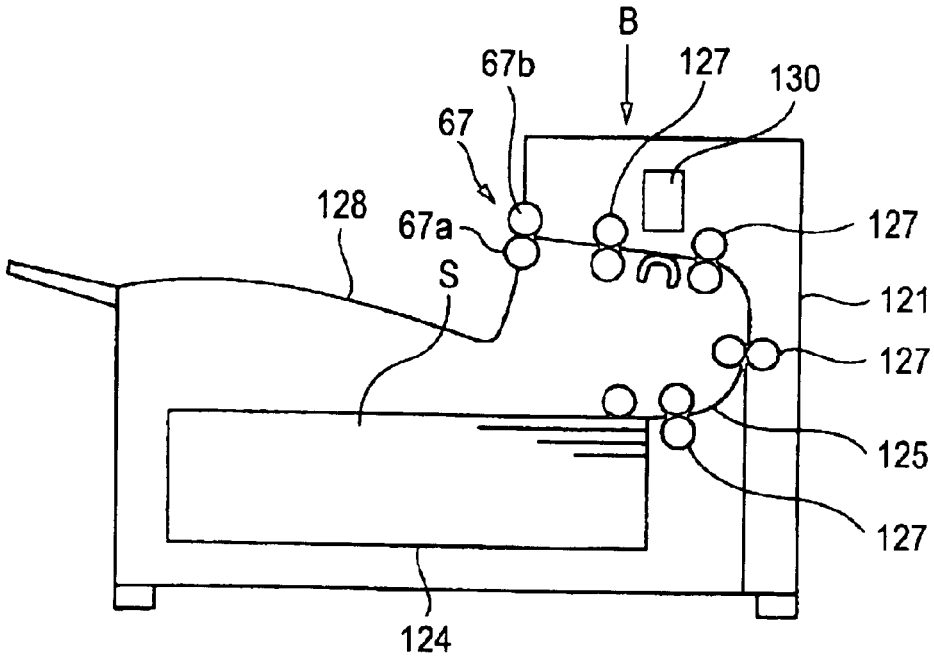
FIG. 19A is a diagram showing a scheme of an image forming apparatus which is an embodiment 3 of the invention.
Figure 19B:
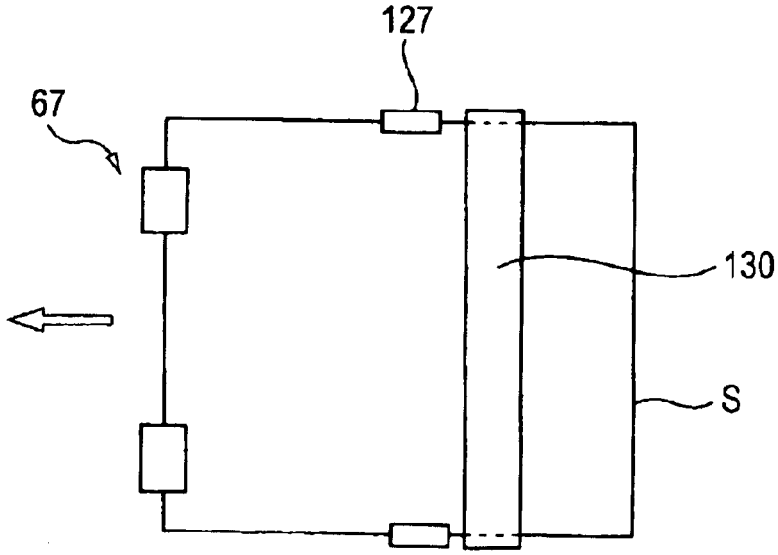
FIG. 19B is a view of the image forming apparatus when viewed in a direction of B as illustrated in FIG. 19A.

FIGS. 19A and 19B show an embodiment 3 of an image forming apparatus in the present invention.

The image forming apparatus of the present invention, unlike embodiments 1 and 2, is based on an ink jet recording system. A sheet supply cassette 124 is provided within a main body 121 of the image forming apparatus. A discharge tray 128 is provided in the upper part of the apparatus main body 121. A sheet transport path 125 is disposed between the sheet supply cassette 124 and the discharge tray 128. An ink jet head 130 is disposed in the middle of the sheet transport path 125. A sheet discharging device 67 (including discharging rolls 67*a* and 67*b*) is provided near the output part of the sheet transport path 125. A proper number of transport rolls 127 are provided on the sheet transport path 125.

In the instant embodiment, the sheet discharging device 67 is substantially the same as embodiment 1 in construction. When the sheet S is a coated sheet, for example, ink dries up slow. To cope with this, the sheet discharging device 67 temporarily holds the sheet S and stops in this state. Then, the sheet is discharged into the discharge tray 128 or sheet S is transported at slow speed while nipped.

Accordingly, if the sheets S are stacked in the discharge tray 128, it can be effectively eliminated such an unwanted situation that the ink fuses on the sheets S and sticks to other sheets.

In the embodiment, immediately after the recording by the ink jet head 130, ink on the sheet S is not yet dried. To prevent irregularities in an image on the sheet S, paired transport rolls 127, located downstream of the ink jet head 130, as shown in FIG. 19B, are arranged so as to nip only both ends of the sheet S as non-image forming areas or to be shaped like a star-wheel

Embodiment 4

Figure 20:
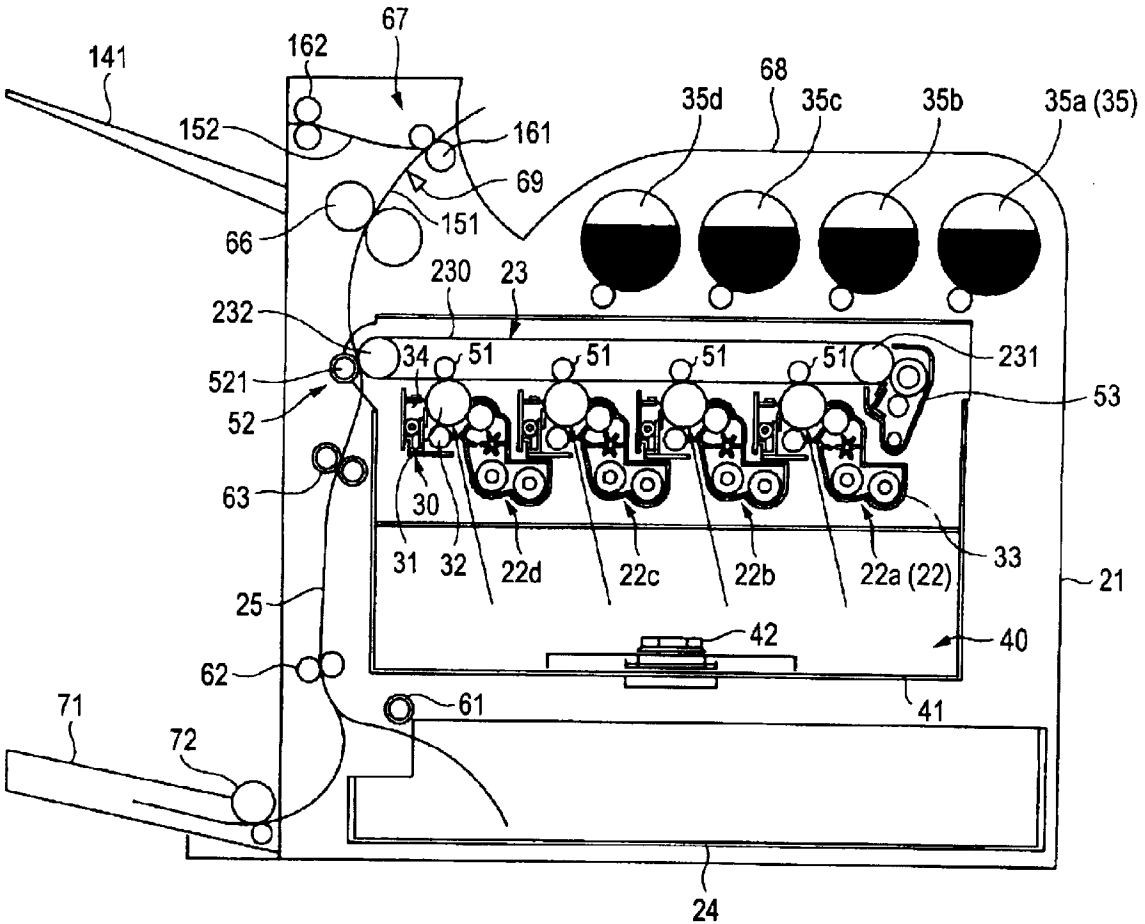
FIG. 20 is a diagram showing a scheme of an image forming apparatus which is an embodiment 4 of the invention.

FIG. 20 shows an embodiment 4 of an image forming apparatus incorporating the present invention.

The instant embodiment is substantially the same as embodiment 1 except that the sheet discharge process by the sheet discharging device 67 is different from that in embodiment 1.

In the instant embodiment, a first discharge tray 68 is provided in the upper part of the apparatus main body 21, and a second discharge tray 141 is provided on the side of the apparatus main body 21.

In the instant embodiment, in the sheet discharging device 67, the sheet transport path 25 includes a first discharge path 151 extending from the fixing device 66 to the first discharge tray 68 and a second discharge path 152 extending□from the output part of the first discharge path 151 to the second discharge tray 141. A first reversible discharge roll 161, is provided near the output part of the first discharge path 151. A second discharge roll 162 is provided at the output part of the second discharge path 152. The sheet discharge path is selected according to a sheet kind or job condition (see description of embodiment 1) by the control unit, not shown.

In the embodiment, when the sheet is a plain paper, the control unit (not shown) carries out a normal discharge control.

The sheet having passed through the fixing device 66 travels through the first discharge path 151 and is discharged into the first discharge tray 68 by the first discharge roll 161.

When the sheet is an OHP sheet or when the number of job sheets is larger than a predetermined number, the control unit carries out a special discharge control to select a discharge path having an increased sheet transport path length. Under the control, the sheet having passed through the fixing device 66 is fed to the first discharge roll 161 by way of the first discharge path 151. Before the trailing edge of the sheet has left the first discharge roll 161, the first discharge roll 161 is reversely rotated to lead the sheet to the second discharge path 152, and then is discharged into the second discharge tray 141 by the second discharge roll 162.

The substantial discharge path length of the sheet following the fixing device 66 corresponds to the sum of the length of the first discharge path 151 and that of the second discharge path 152. Accordingly, the sheet is sufficiently cooled during its traveling through the discharge paths 151 and 152.

Therefore, even when the sheet is an OHP sheet and the number of job sheets is large, the sheet is discharged to the second discharge tray 141 in a state that it is sufficiently cooled. Further, also when the sheets are stacked on the second discharge tray 141, there is no fear that the image on the sheet fuses and attaches to other sheets.

Even where the discharge path is set to be long, if the span between the sheets is selected to be short appropriately, the possibility of the lowering of the copy productivity is lessened.

Embodiment 5

Figure 21:
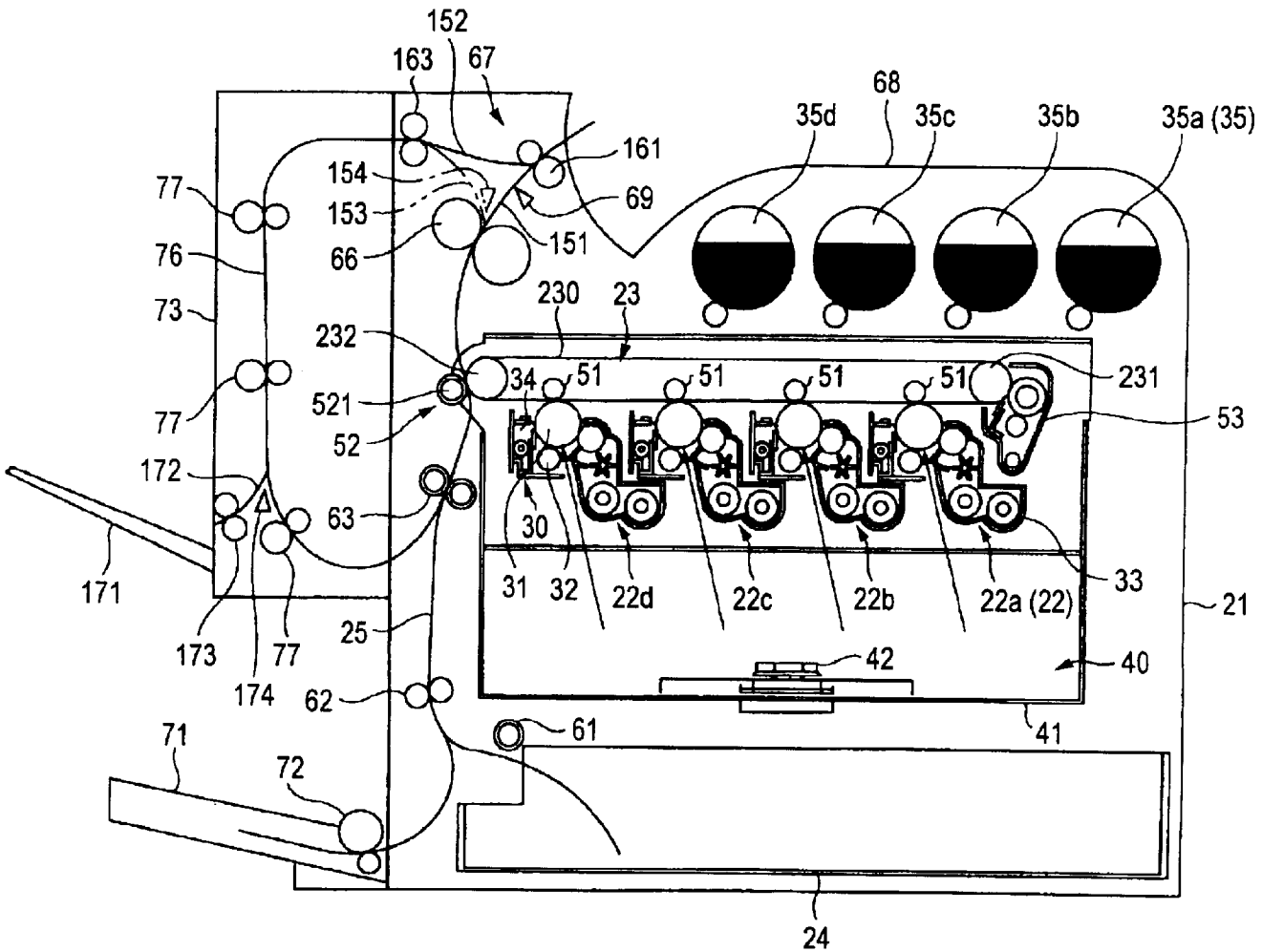
FIG. 21 is a diagram showing a scheme of an image forming apparatus which is an embodiment 5 of the invention.

FIG. 21 shows an embodiment 5 of an image forming apparatus incorporating the present invention.

A basic construction of the image forming apparatus of the instant embodiment is substantially the same as that of the embodiment 4. Differences of embodiment from embodiment 4 follow. A both-side recording unit 73 (see embodiment 1) is installed on the side of the apparatus main body 21. A second discharge tray 171 is provided at a part of the both-side recording unit 73. A branch discharge path 172 is provided ranging from a part of the sheet return transport path 76 in the both-side recording unit 73 to the second discharge tray 171. A second discharge roll pair 173 is provided at its output part. A select gate 174 is provided at its branching part. With such an arrangement, a different discharge path is selected, as a sheet discharge process by the sheet discharging device 67.

Reference numeral 163 is a transport roll pair provided at the output part of the secondary transfer device 52. Like or equivalent component parts are designated by like reference numerals in embodiment 4, and detailed description of them are omitted.

In the instant embodiment, the sheet discharging device 67 selects the sheet discharge path according to a sheet kind or job condition under control of the control unit (not shown). To be more specific, when the sheet is a plain paper, the control unit (not shown) carries out a normal discharge control, and the sheet having passed through the fixing device 66 is discharged into the first discharge tray 68 by way of the first discharge path 151.

When the sheet is an OHP sheet or when the number of job sheets is larger than a predetermined number, the control unit carries out a special discharge control to select a discharge path having an increased sheet transport path length. Under the control, the sheet having passed through the fixing device 66 is fed to the first discharge roll 161 by way of the first discharge path 151. Before the trailing edge of the sheet has left the first discharge roll 161, the first discharge roll 161 is reversely rotated to lead the sheet to the second discharge path 152. Then, the sheet is led to the sheet return transport path 76 by the transport roll pair 163, and is discharged into the second discharge tray 171 by way of the select gate 174, branch discharge path 172, and the second discharge roll pair 173.

The substantial discharge path length of the sheet following the fixing device 66 corresponds to the length sum of the first discharge path 151, second discharge path 152, sheet return transport path 76 (used as the discharge path), and branch discharge path 172. Accordingly, the sheet is sufficiently cooled during its traveling through the discharge paths 151, 152, 76, and 172.

Therefore, even when the sheet is an OHP sheet and the number of job sheets is large, the sheet is discharged to the second discharge tray 141 in a state that it is sufficiently cooled. Further, also when the sheets are stacked on the second discharge tray 171, there is no fear that the image on the sheet fuses and attaches to other sheets.

Even where the discharge path is set to be long, if the span between the sheets is selected to be short appropriately, the possibility of the lowering of the copy productivity is lessened.

In the instant embodiment, when the sheet return transport path 76 of the both-side recording unit 73 is used as the discharge path, the path ranging from the first discharge path 151 and the second discharge path 152 is used. In an alternative, as indicated by a phantom line in FIG. 21, a third discharge path 153 is provided which branches off from the first discharge path 151 at a downstream position of the fixing device 66. The third discharge path. 153 is selected by a select gate 154 whereby a long discharge path is formed communicating with the sheet return transport path 76.

Embodiment 6

Figure 22:
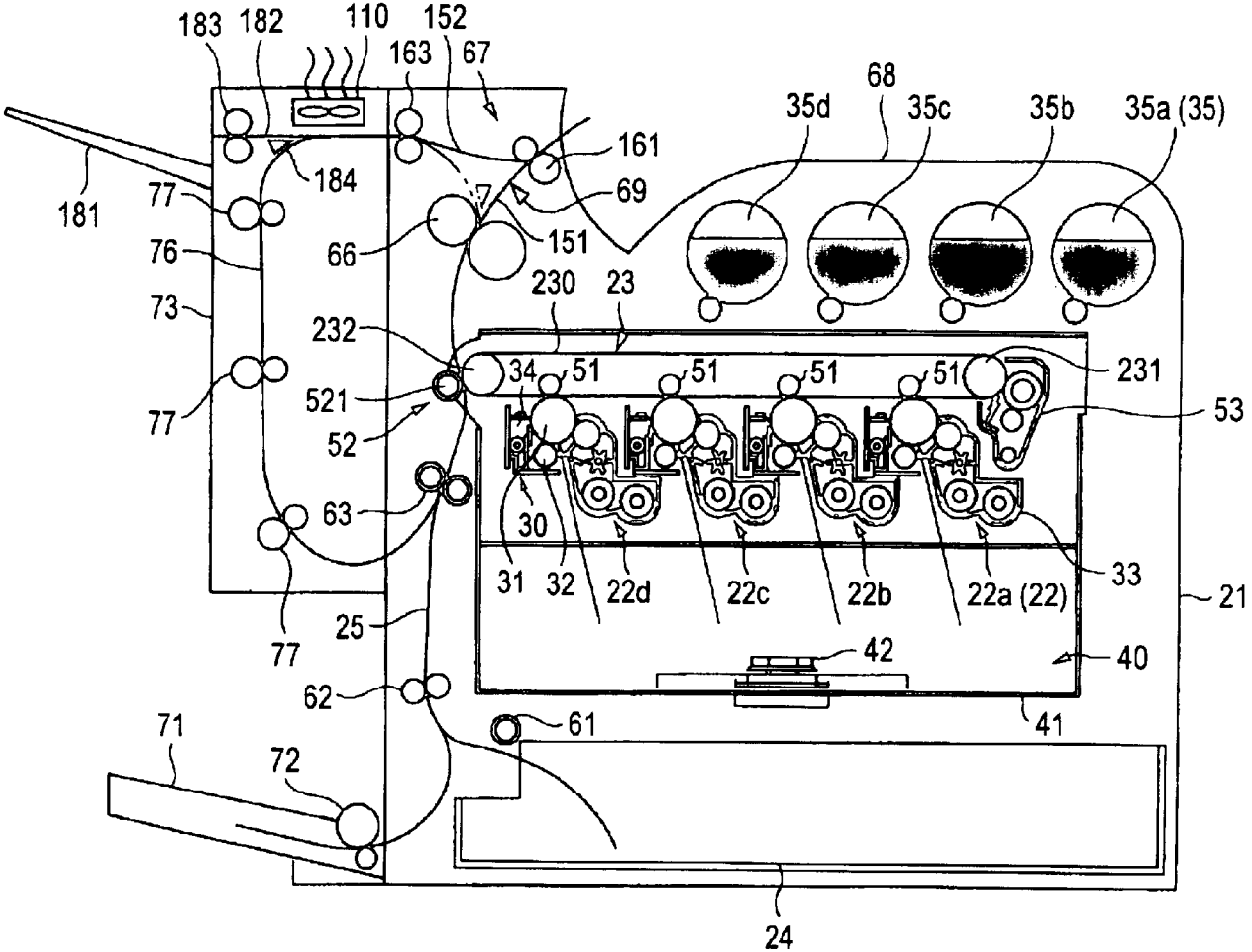
FIG. 22 is a diagram showing a scheme of an image forming apparatus which is an embodiment 6 of the invention.

FIG. 22 shows an embodiment 6 of an image forming apparatus incorporating the present invention.

A basic construction of the image forming apparatus of the instant embodiment is substantially the same as that of embodiment 5. The instant embodiment is different from embodiment 5 (the second discharge tray 171 is provided at a lower part of side of the both-side recording unit 73) in the following points. A second discharge tray 181 is provided at an upper part of the side of the both-side recording unit 73. A branched discharge path 182, which is directed toward the second discharge tray 181, is disposed while ranging from a horizontal part in the upper part of the sheet return transport path 76 within the both-side recording unit 73 to a vertical part of the side thereof. A second discharge roll pair 183 is provided near the output part thereof. A select gate 184 is disposed at a branching part at which the branched discharge path 182 is branched off from the sheet return transport path 76. In the instant embodiment, like or equivalent portions are designated by like reference numerals in embodiment 5, and detailed description thereof are omitted.

In particular, in the instant embodiment, the sheet discharging device 67 includes a discharge path ranging to the first discharge tray 6B and a discharge path ranging to the second discharge tray 181. A cooling fan 110 as a forcibly cooling device is disposed above the upper horizontal part of the sheet return transport path 76.

The control unit (not shown) selects a discharge path, as a sheet discharge process by the sheet discharging device 67, according to sheet kind or job condition. Further, when the sheet is transported to the sheet return transport path 76, the control unit operates the cooling fan 110.

Accordingly, in the embodiment, when the sheet is a plain paper, the control unit (not shown) carries out a normal discharge control. The sheet having passed through the fixing device 66 is discharged into the first discharge tray 68 by way of the first discharge path 151.

When the sheet is an OHP sheet or when the number of job sheets is larger than a predetermined number, the control unit carries out a special discharge control to select a discharge path having an increased sheet transport path length. Under the control, the sheet having passed through the fixing device 66 is fed to the first discharge roll 161 by way of the first discharge path 151. Before the trailing edge of the sheet leaves the first discharge roll 161, the first discharge roll 161 is reversely rotated to lead the sheet to the second discharge path 152. Then, the sheet is led to the sheet return transport path 76 by the transport roll pair 163, and thereafter is discharged to the second discharge tray 181 by way of the branched discharge path 182 and the second discharge roll pair 183.

A long discharge path (first discharge path 151, second discharge path 152, the upper horizontal part of the sheet return transport path 76, and branched discharge path 182) is selected to be shorter as the total length than that of embodiment 5. In the instant embodiment, however, the cooling effect by the cooling fan 110 auxiliarily operates, and the sheet, e.g., OHP sheet, which travels along this discharge path, is sufficiently cooled.

Therefore, even when the sheet is an OHP sheet and the number of job sheets is large, the sheet is discharged to the second discharge tray 181 in a state that it is sufficiently cooled. Further, also when the sheets are stacked on the second discharge tray 181, there is no fear that the image on the sheet fuses and attaches to other sheets.

In particular, in the embodiment, when the sheet is transported to the sheet return transport path 76, the cooling fan 110 is operated. For example, when the sheet having an image recorded on one side is returned by the both-side recording unit 73, the sheet is actively cooled by the cooling fan 110.

In another words, when an image is fixed on one sides of the sheet by the fixing device 66, the sheet is heated. By transported through the sheet return transport path 76, this heated sheet is cooled by the cooling fan 110. Therefore, even if the sheet having an image recorded on only one side is transported through the secondary transfer part, the atmospheric temperature within the apparatus main body 21 unnecessarily rises.

Embodiment 7

Figure 23:
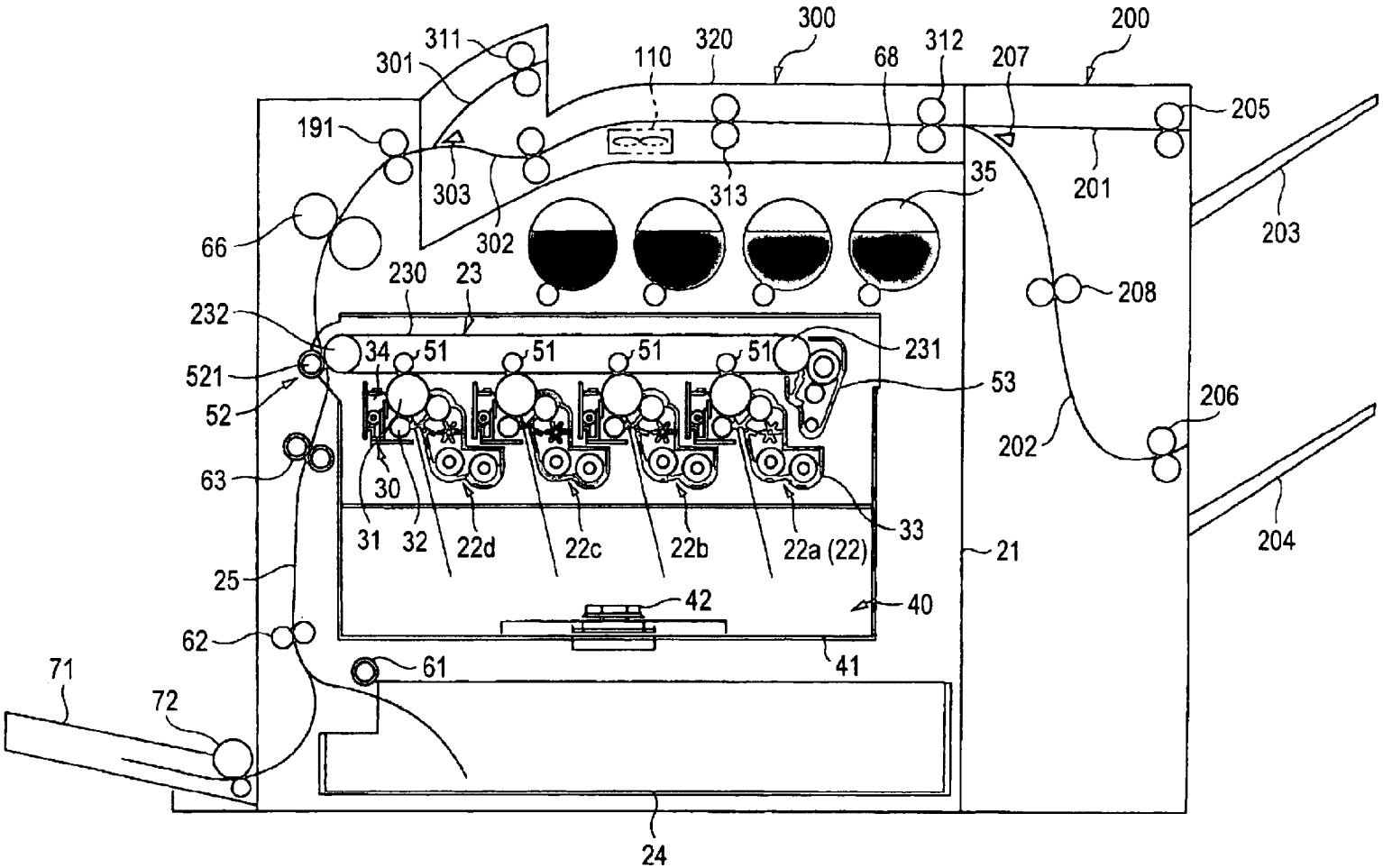
FIG. 23 is a diagram showing a scheme of an image forming apparatus which is an embodiment 7 of the invention.

FIG. 23 shows an embodiment 7 of an image forming apparatus incorporating the present invention.

Figure 1:
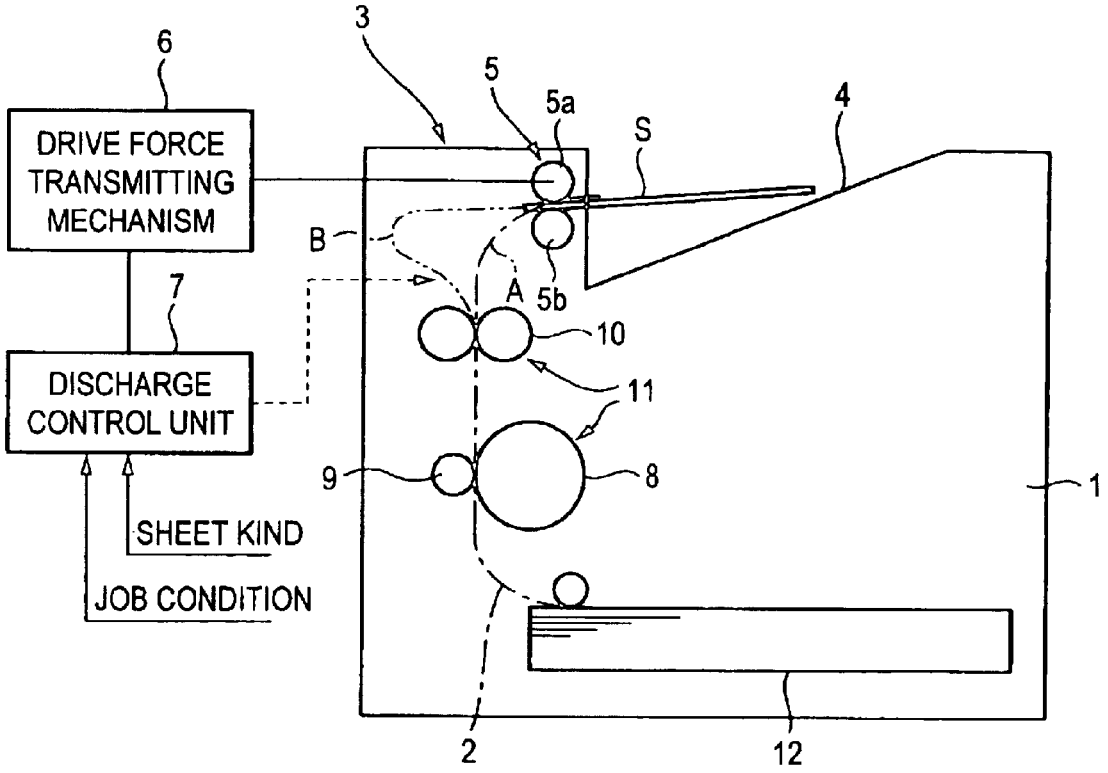
FIG. 1 is a diagram showing a scheme of an image forming apparatus constructed according to the present invention.

A basic construction of the image forming apparatus of the instant embodiment is substantially the same as that of embodiment 4. This embodiment is different from the sheet receiving part 4 in FIG. 1 in that a finisher 200 is provided on the side of the apparatus main body 21.

For the sheet discharging device 67, a transport unit 300 is provided on the upper part of the apparatus main body 21. A transport roll pair 191 is provided at the output part of the sheet transport path 25 within the apparatus main body 21. The sheet transport path 25 is branched off into first and second discharge paths 301 and 302 within the transport unit 300. A first discharge roll pair 311 is located near the output part of the first discharge path 301. A second discharge roll pair 312 is located near the output part of the second discharge path 302. The discharge path is selected according to a sheet kind or job condition by a control unit (not shown).

In FIG. 23, reference numeral 303 is a select gate for selecting the discharge path 301 or 302; 313 is an appropriate number of transport roll pairs; 320 is a discharge tray on the transport unit 300; 201 and 202 are sheet transport paths within the finisher 200; 203 and 204: are discharge trays; 205 and 206 are discharge roll pairs provided near the output parts of the sheet transport paths 201 and 202; 207 is a select gate for selecting the sheet transport path 201 or 202; and 208 is a transport roll pair. If necessary, a cooling fan 110 as a forcibly cooling device may be provided on the second discharge path 302 destined for the finisher 200 within the transport unit 300.

In the embodiment, when the sheet is a plain paper, the control unit (not shown) carries out a normal discharge control. A sheet having passed through the fixing device 66 is led to the transport unit 300 by way of the transport roll pair 191, and further led, by the select gate 303, to the first discharge path 301 and the first discharge roll pair 311, and finally discharged to the discharge tray 320.

When the sheet is an OHP sheet or when the number of job sheets is larger than a predetermined number, the control unit carries out a special discharge control to select a discharge path having an increased sheet transport path length. The sheet having passed through the fixing device 66 is led to the transport unit 300 by way of the transport roll pair 191. The sheet is led, by the select gate 303, to the second discharge path 302 and the second discharge roll pair 312, and fed to the finisher 200. And, the sheet travels along the sheet transport path 201 or 202 and is discharged into the discharge tray 203 or 204.

A substantial length of the sheet discharge path following the fixing device 66 includes the second discharge path 302 (having a path length being sufficiently longer than the first discharge path 301) of the transport unit 300 and the sheet transport path 201 or 202 within the finisher 200. Therefore, a sufficiently long sheet transport path length is secured. Accordingly, the sheet is satisfactorily cooled during its traveling along the second discharge path 302 and sheet transport path 201.

Therefore, the image defects on the sheets stacked are effectively avoided, as in embodiments 4 and 5.

Embodiment 8

Figure 24:
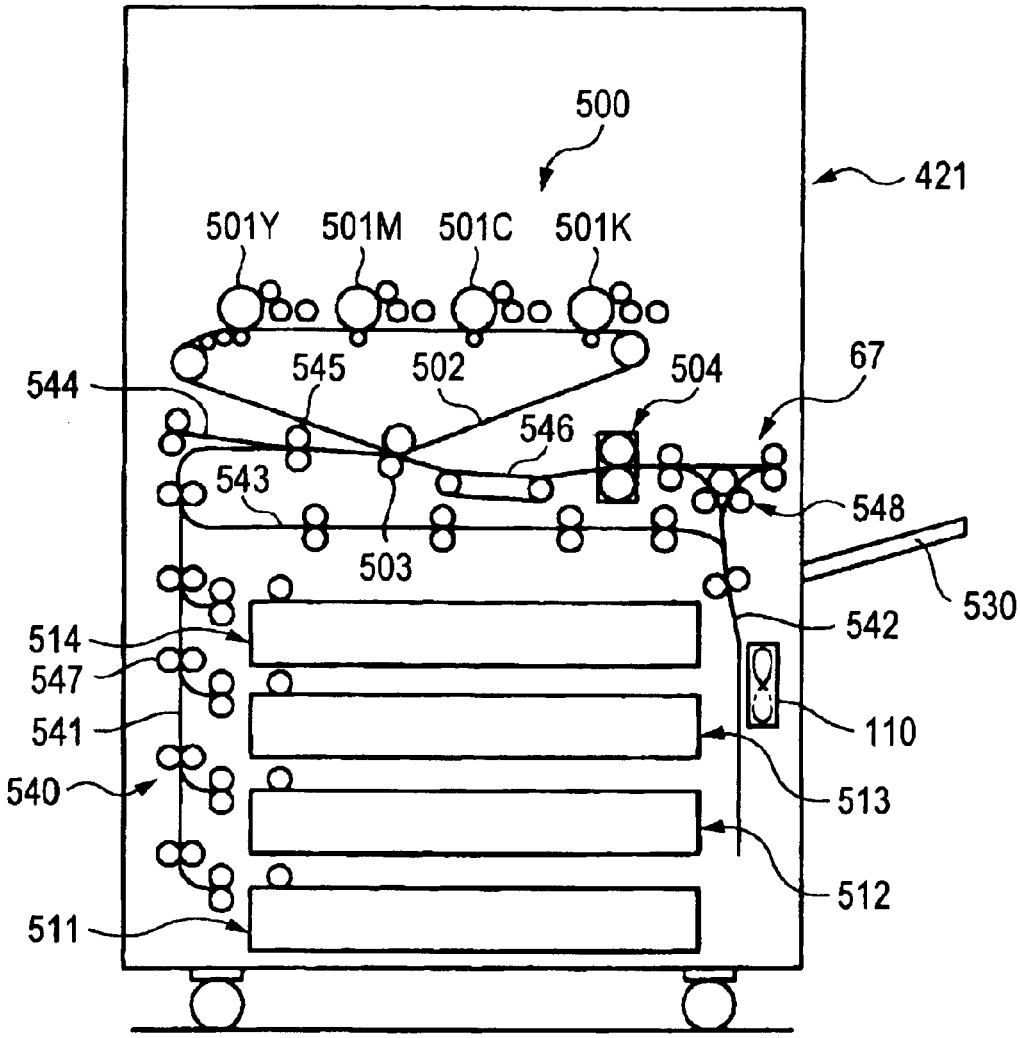
FIG. 24 is a diagram showing a scheme of an image forming apparatus which is an embodiment 8 of the invention.

FIG. 24 shows an embodiment 7 of an image forming apparatus incorporating the present invention.

In FIG. 24, the image forming apparatus is of the intermediate transfer type. An image forming module 500 for forming toner images of color components is disposed in an upper part in an apparatus main body 421. Multistage sheet supply trays 511 to 514 are disposed under the image forming module 500.

In the image forming module 500, photoreceptor drums 501 (501Y to 501K) are disposed side by side. Color component toner images formed on the photoreceptor drums 501 are transferred onto an intermediate transfer belt 502. In a secondary transfer unit 503, color component toner images are secondarily transferred from the intermediate transfer belt 502 onto a sheet which is fed from any of the sheet supply trays 511 to 514, and then is led to a fixing unit 504.

In this embodiment, a sheet transport path 540 ranging from the sheet supply trays 511 to 514 includes a main transport path 541 which is directed upward from the left side (as viewed in the drawing) in the apparatus main body 421, and then to a discharge tray 530 by way of the secondary transfer part of the image forming module 500 and the fixing unit 504, a reverse transport path 542 which is bent, like Y, to the lower side at a position of the output part of the main transport path 541, and reverses the front and back sides of the sheet and transports the sheet, and a return path 543 which is communicatively connected to a part of the reverse transport path 542, and returns the reversed sheet to the main transport path 541 located upstream of the image forming module 500.

A register roll 545, which positions and transports the sheet, is located upstream of the secondary transfer part of the main transport path 541. A transport belt 546 transports the sheet to the fixing unit 504 and is located downstream of the secondary transfer part. An appropriate number of transport roll pairs 547 are provided along the transport paths 541 to 543. A reversing mechanism 548 for reversing the front and back sides of the sheet and transporting the reversed sheet is provided on the reverse transport path 542.

In particular, in the instant embodiment, the sheet discharging device 67 selects the discharge path according to a sheet kind or job condition under control of the control unit.

To be more specific, when the sheet is a plain paper, the control unit (not shown) carries out the normal discharge process, whereby the sheet having passed through the fixing unit 504 is directly discharged into the discharge tray 530.

When the sheet is an OHP sheet or when the number of job sheets is larger than a predetermined number, the control unit carries out a special discharge control to select a discharge path having an increased sheet transport path length. The sheet having passed through the fixing unit 504 is led to the reverse transport path 542 and then discharged into the discharge tray 530.

Accordingly, also in the instant embodiment, a substantial length of the discharge path following the fixing unit 504 is elongated by the utilization of the reverse transport path 542. Therefore, the sheet is sufficiently cooled during its traveling through the reverse transport path 542 and the like, so that the image defects on the sheets stacked are effectively avoided, as in embodiments 4 and 5.

A cooling fan 110 as the forcibly cooling device may be disposed in the reverse transport path 542, if necessary.

In this case, the cooling fan 110 cools the sheet to be discharged. If the cooling fan 110 is so arranged as to operate when the sheet is returned to the return path 543 in the both-side recording mode or a multiple recording mode, the sheet can be cooled by the cooling fan 110 when the sheet heated by the fixing unit 504 is returned to the image forming part. Accordingly, it is effectively avoided that temperature within the main body 1 rises when the sheet is returned to the image forming part in the both-side recording mode or the like.

Embodiment 9

Figure 25:
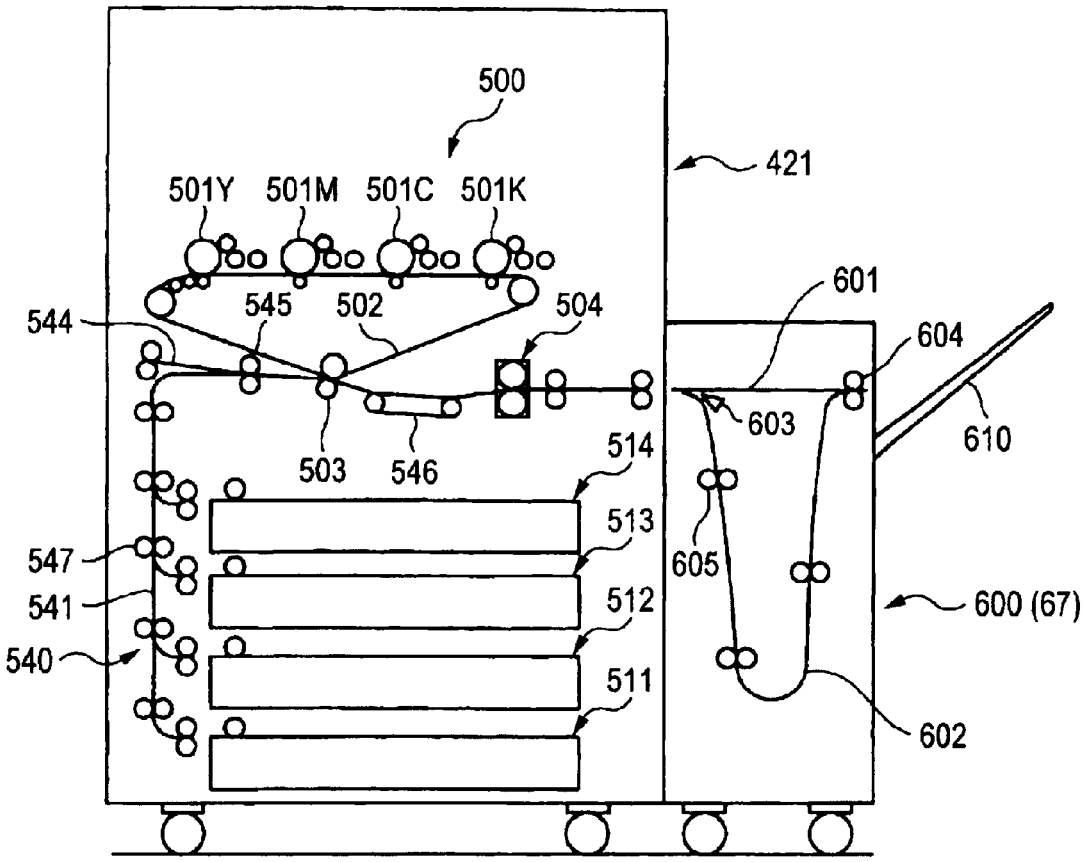
FIG. 25 is a diagram showing a scheme of an image forming apparatus which is an embodiment 9 of the invention.

FIG. 25 shows an embodiment 9 of an image forming apparatus incorporating the present invention.

A basic construction of the image forming apparatus of the instant embodiment is substantially the same as that of embodiment 8. The difference of the instant embodiment from embodiment 8 resides in that a finisher 600 is provided on the side of the apparatus main body 421, and the reverse transport path 542 and the return path 543 are not provided within the apparatus main body 421.

The finisher 600 includes a first discharge path 601, linear in shape, and a second discharge path 602 which is branched off from the first discharge path 601 and extends by a roundabout route. A select gate 603 is disposed at the branching point, and communicates with a discharge tray 610 via the discharge paths 601 and 602.

A discharge roll pair 604 is provided at a junction point where the discharge paths 601 and 602 meet. An appropriate number of transport roll pairs 605 are disposed along the second discharge path 602.

In the instant embodiment, the finisher 600 selects one of the two discharge paths 601 and 602 according to a sheet kind or job condition under control of the control unit.

Specifically, when sheet is an OHP sheet or when the number of job sheets is larger than a predetermined number, the control unit carries out a special discharge control to select a second discharge path 602 having an increased sheet transport path length. The sheet having passed through the fixing unit 504 is led to the second discharge path 602, and then is discharged to the discharge tray 610 by way of the discharge roll pair 604.

For this reason, also in this embodiment, a substantial length of the sheet discharge path following the fixing unit 504 is sufficiently long. The sheet is sufficiently cooled during its traveling through the second discharge path 602. The image defects on the stacked sheets are effectively avoided.

Design modification may be applied optionally within a range not departing the technical concept of the present invention. For example, the reverse transport path as in embodiment 7 may be provided within the finisher 600.

As seen from the foregoing description, when the sheet passes the discharging member, a time taken for sheet discharging by the discharging member is temporarily delayed by the drive force transmitting mechanism. Even when an OHP sheet is used for the sheet, the sheet is naturally cooled sufficiently before the sheet is stacked on the sheet receiving part, without the aid of a cooling device, for example.

Accordingly, the invention is capable of effectively preventing image defects, which arise from the fusing of image forming materials (e.g., toner) of sheets to be stacked on a sheet receiving part, while minimizing the lowering of the copy productivity.

Thus, in the image forming apparatus of the invention, the image defects can be effectively prevented at the stage of the sheet discharging, thereby providing high quality images without image defects.

In another image forming apparatus of the invention, a plurality of discharge paths having different sheet transport lengths are provided, and the sheet discharge path is selected according to a sheet kind or job condition. Accordingly, even when an OHP sheet is used, the sheet can be sufficiently cooled by selecting the long discharge path having a long sheet transport length because if such a discharge path is selected, sufficient time is gained till the sheet is discharged and the sheet is sufficiently cooled naturally before the sheet is stacked on the sheet receiving part.

Accordingly, the invention is capable of effectively preventing image defects, which arise from the fusing of image forming materials (e.g., toner) of sheets to be stacked on a sheet receiving part, while minimizing the lowering of the copy productivity, to thereby provide high quality images without image defects.

What is claimed is:

1. An image forming apparatus comprising:

a main body including a sheet transport path and an image forming part, the sheet transport path including an output part, the image forming part for forming an image on a sheet; and a sheet discharging device, located in the vicinity of the output part, for discharging the sheet having an image formed thereon by the image forming part; and a sheet receiving part for receiving the sheet discharged by the sheet discharging device;

wherein the sheet discharging device comprises:

a discharging member, disposed in the vicinity of the output part, for transporting the sheet in a nipping manner;

a drive force transmitting mechanism for driving the discharging member to rotate; and a discharge control unit for controlling the drive force transmitting mechanism when the sheet passes the discharging member so as to temporarily delay a time taken for sheet discharging by the discharging member.

2. The image forming apparatus according to claim 1, wherein the image forming part includes a fixing device for heating and fixing an image having been transferred onto the sheet.

3. The image forming apparatus according to claim 1, wherein the discharge control unit temporarily stops driving the discharging member to rotate when the sheet passes the discharging member.

4. The image forming apparatus according to claim 3, wherein the discharge control unit releases the discharging member from a restrained state by the drive force transmitting mechanism so as to allow the sheet nipped by the discharging member to be pulled out to the sheet receiving part, while the discharge control unit temporarily stops driving the discharging member to rotate.

5. The image forming apparatus according to claim 1, wherein the discharge control unit makes a sheet-to-sheet span wider than a normal sheet-to-sheet span to carry out a temporary delaying process of the sheet discharging time by the discharging member.

6. The image forming apparatus according to claim 5, wherein the image forming part includes a fixing device for heating and fixing an image having been transferred onto the sheet; and the discharge control unit widens the sheet-to-sheet span so that time from a moment that the trailing edge of the sheet passes the fixing device to a moment that the trailing edge passes the discharging member exceeds a predetermined value of time necessary for cooling the sheet.

7. The image forming apparatus according to claim 1, wherein the discharge control unit selectively carries out a temporary delaying process of a sheet discharging time by the discharging member in accordance with a type of the sheet.

8. The image forming apparatus according to claim 7, wherein the discharge control unit selectively carries out the temporary delaying process at least under a condition where the sheet is an OHP sheet.

9. The image forming apparatus according to claim 8, wherein when a slip sheet mode is selected, the discharge control unit prohibits the temporary delaying process even under a condition where the sheet is an OHP sheet.

10. The image forming apparatus according to claim 1, wherein the discharge control unit variably sets a delay time of a time taken for the discharging member to discharge the sheet in accordance with a type of the sheet.

11. The image forming apparatus according to claim 1, wherein the discharge control unit selectively carries out a temporary delaying process of a sheet discharging time by the discharging member in accordance with a job condition.

12. The image forming apparatus according to claim 11, wherein the discharge control unit selectively carries out the temporary delaying process in accordance with number of sheets set in a subject job.

13. The image forming apparatus according to claim 11, wherein the discharge control unit selectively carries out the temporary delaying process for those sheets subsequent to a specified number of sheets when number of sheets set in one subject job is larger than a predetermined number.

14. The image forming apparatus according to claim 11, wherein under a condition that a subsequent job to be processed is continuous to a preceding job, the discharge control unit selectively carries out the temporary delaying process in accordance with the sum of number of sheets set in the preceding job and number of sheets set in the subsequent job.

15. The image forming apparatus according to claim 14, wherein the discharge control unit selectively carries out the temporary delaying process in consideration of a time between the preceding job and the subsequent job.

16. The image forming apparatus according to claim 11, wherein the discharge control unit is capable of varying number of sheets set in a job and a specific number of sheets to be utilized in the temporary delaying process.

17. The image forming apparatus according to claim 1, wherein the discharge control unit is capable of canceling a temporary delaying process of a sheet discharging time by the discharging member.

18. The image forming apparatus according to claim 1, further comprising a forcibly cooling device for cooling a surface of the sheet.

19. An image forming apparatus, comprising:

a main body including a sheet transport path and an image forming part, the sheet transport path including an output part, the image forming part for forming an image on a sheet; and a sheet discharging device, located in the vicinity of the output part, for discharging the sheet having an image formed thereon by the image forming part; and a sheet receiving part for receiving the sheet discharged by the sheet discharging device;

wherein the sheet discharging device comprises:

a discharging member, disposed in the vicinity of the output part, for transporting the sheet in a nipping manner;

a plurality of discharging paths of different lengths provided within a range from the image forming part to the discharging member in the sheet transport path; and a discharge control unit for selecting an appropriate discharging path from the plurality of discharging paths according to a type of the sheet or a job condition.

20. The image forming apparatus according to claim 19, wherein a plurality of the discharging paths includes a long discharging path which is longer than others; and the long discharging path is a bypass using a sheet transport path for another purpose.

21. The image forming apparatus according to claim 20, wherein the sheet transport path for another purpose is a sheet return path for a both-sided recording purpose or a multiple recording purpose; and a forcibly cooling device for cooling a surface of the sheet is provided at the sheet return path.

22. The image forming apparatus according to claim 19, wherein the discharging member includes a plurality of discharging members, each provided on one of the plurality of discharging paths at different positions respectively.

23. The image forming apparatus according to claim 19, further comprising a forcibly cooling device for cooling a surface of the sheet;

wherein the forcibly cooling device is located at the one of the plurality of discharging paths.

24. The image forming apparatus according to claim 19, wherein the plurality of discharging paths shares the discharging member in transporting the sheet to the sheet receiving part.

25. The image forming apparatus according to claim 19, wherein the discharging of the sheet according to which the discharge control unit selects the discharging path includes a OHP sheet, a coated sheet, or an another type of sheet (i.e., normal paper, plain paper).

26. The image forming apparatus according to claim 19, wherein the job condition according to which the discharge control unit selects the discharging path includes a single job, a continuous job, a both-sided recording, a multiple recording, or a condition in which the number of job sheets is larger than a predetermined number.

27. An image forming apparatus, comprising:

a main body including a sheet transport path and an image forming part, the sheet transport path including an output part, the image forming part for forming an image on a sheet; and a sheet discharging device, located in the vicinity of the output part, for discharging the sheet having an image formed thereon by the image forming part; and a sheet receiving part for receiving the sheet discharged by the sheet discharging device;

wherein the sheet discharging device comprises:

a discharging member, disposed in the vicinity of the output part, for transporting the sheet in a nipping manner;

a plurality of discharging paths of different lengths provided within a range from the image forming part to the discharging member in the sheet transport path; and a discharge control unit for selecting an appropriate discharging path from the plurality of discharging paths according to a type of the sheet or a job condition wherein a plurality of the discharging paths includes a long discharging path which is longer than others; and the long discharging path is a bypass using a sheet transport path for another purpose.

28. The image forming apparatus according to claim 27, wherein the sheet transport path for another purpose is a sheet return path for a both-sided recording purpose or a multiple recording purpose; and a forcibly cooling device for cooling a surface of the sheet is provided at the sheet return path.

* * * * *